US005244092A

United States Patent [19]

Karita et al.

[11] Patent Number: 5,244,092

[45] Date of Patent: Sep. 14, 1993

[54] PACKAGE FOR INK JET CARTRIDGE

[75] Inventors: Seiichiro Karita, Yokohama; Akio Saito, Hadano, both of Japan

[73] Assignee: Canon Kabushiki Kaisha, Tokyo, Japan

[21] Appl. No.: 872,317

[22] Filed: Apr. 23, 1992

Related U.S. Application Data

[62] Division of Ser. No. 621,989, Dec. 4, 1990, Pat. No. 5,131,539.

[30] Foreign Application Priority Data

Dec. 6, 1989 [JP] Japan ..... 1-318080
Dec. 6, 1989 [JP] Japan ..... 1-318081
Dec. 6, 1989 [JP] Japan ..... 1-318082

[51] Int. Cl.[5] ..... B65D 73/00
[52] U.S. Cl. ..... 206/462; 206/806
[58] Field of Search ..... 206/462, 461, 471, 470, 206/806

[56] References Cited

U.S. PATENT DOCUMENTS 2,884,127 4/1959 Neary ..... 206/462
3,129,817 4/1964 Rohdin .
3,246,747 4/1966 Blish ..... 206/462
3,289,830 12/1966 Foote .
3,303,930 2/1967 Hyland .
3,399,763 9/1968 Stone .
4,125,190 11/1978 Davie, Jr. et al. .
4,313,124 1/1982 Hara .
4,345,262 8/1982 Shirato et al. .
4,459,600 7/1984 Sato et al. .
4,463,359 7/1984 Ayata et al. .
4,558,333 12/1985 Sugitani et al. .
4,723,129 2/1988 Endo et al. .
4,734,717 3/1988 Rayfield .
4,740,796 4/1988 Endo et al. .

FOREIGN PATENT DOCUMENTS 804980 1/1969 Canada .
54-056847 5/1979 Japan .
59-123670 7/1984 Japan .
59-138461 8/1984 Japan .
60-071260 4/1985 Japan .
6159557 4/1986 Japan ..... 206/462
90013494 11/1990 PCT Int'l Appl. .
1507828 4/1978 United Kingdom .
2196320 4/1988 United Kingdom .

*Primary Examiner*—William I. Price
*Attorney, Agent, or Firm*—Fitzpatrick, Cella, Harper & Scinto

[57] ABSTRACT

A package for an ink jet cartridge includes an accommodating container having a main body for accommodating the ink jet cartridge and a flange for sealed connection between the main body and a cover; and a holding member having an opening defining member for defining an opening for insertion of the main body therethrough and a flat member cooperable with the opening defining member to sandwich the flange therebetween, the opening defining member having an edge portion contactable to an outer edge of the flange and a peripheral portion around the outer edge.

5 Claims, 29 Drawing Sheets

PACKAGE FOR INK JET CARTRIDGE

This application is a division of application Ser. No. 07/621,989 filed Dec. 4, 1990, now U.S. Pat. No. 5,131,539.

FIELD OF THE INVENTION AND RELATED ART

The present invention relates to a package for an ink jet cartridge having a container and a supporting member therefor, suitable for the packaging of the ink jet cartridge which is desirably not to be subjected to shock such as vibration or impact upon falling.

As for a package container for packaging and protecting goods which are liable to be damaged by shock or the like, there are various package containers made of materials having a buffering function such as paper, corrugated cardboard, foaming sheet, foamed styrol or polyurethane or other resin mold materials.

However, when the corrugated cardboard is used, the local strength thereof is not always sufficient, and therefore, a local external force easily results in local deformation or damage. Particularly when the sizes of the contents and the corrugated cardboard are not matched, the package is damaged, if the shock by the falling or vibration is applied to the package. If this occurs, a protecting function is not provided, and therefore, the contents are deformed or damaged.

Similarly to the corrugated cardboard, the package made of paper, resin or wood, the content dances during carrying thereof, if the sizes of the contents and the package are not matched. The shock may result in damage of the contents.

In some cases, the contents may be packed, while being wrapped with buffering material such as resin sheet, resin material with air bubbles or the like. This type is satisfactory to some extent form the standpoint of protection of the content. However, the wrapping of the contents with the sheet material requires cumbersome packing operations. In addition, the volume of the contents increases with the result of a bulky outer package. Furthermore, the cost is therefore increased, and a larger accommodating space for the packing is required. In addition, even if the sheet material is used, and if the contents have projections and recesses, the protecting function is not satisfactory. As for another package, the cushion member is made of foaming resin mold of resin material, typical example of which include the foaming urethane or foamed styrol material. Such packages are easily molded in compliance with the configuration of the content. In addition, it is good in the buffering function, and therefore, the protecting function and the positioning in the container is very good However, in order to obtain a sufficient buffering function in the foamed styrol mold, the thickness has to be large with the result of increased volume of the package. For example, the volume of the packing container made of that material is as large as 2–3 times of the packing container using the corrugated cardboard only. Such a significant increase of the required space places substantial burden from the standpoint of storage space and the distribution cost.

The mechanical strength of that mold is no so high that it is easily damaged by local shock or the like. Therefore, it is generally coated with a film material or a corrugated cardboard in the form of a sleeve covering the foamed styrol case. Therefore, the packing cost is high.

Another packing container comprises a main container body made of vinyl chloride mold such as blister pack or the like and a vinyl chloride layer at the bonding portion with the main body, and a thick paper bonded as a bottom plate to the main body.

The packing container has both of the packing function and the contents protecting function. However, the protection of the contents is not satisfactory. Although it has a high strength, and therefore, it is used for the goods which are strong and are not easily damaged or deformed or the goods which are not so expensive in case where they are damaged.

As will be understood, it is not easy to find a package which is satisfactory in the protection of the contents, the required space and the cost for the packing.

The package is required to have not only the resistivity against the external shock but also the protection of the contents from the ambience, more particularly, the ambient condition change such as temperature or humidity change, as the case may be. For example, for the purpose of protection from the moisture, some packages are made of a thin film of aluminum. It is sealed, and is accommodated in the container package, or it is accommodated in a strong case made of aluminum plate together with a shock absorbing material.

However, in any of the above cases, the cost of the material is high, and the protecting function is not always sufficient. During the carrying, it may be collapsed with the weight of other goods, or it may fall, and the sealing is easily damaged. In addition, the casing made of aluminum is sometimes deformed.

An accommodating container (package container) for an ink jet container has been proposed which is satisfactory in the protection of the contents, the requirement for the space of the package and the requirement for the packing cost or the like are satisfactory, and in addition, the humidity ambience of the contents can be maintained. This can be said to be a precision package.

The container for the ink jet head cartridge has a space for accommodating the ink jet head cartridge, and comprises a main body having a wall adapted to be out of contact with the ink jet head cartridge and a recess from the wall into the accommodating space and adapted to be in contact with the ink jet cartridge to support it, and a plate-like member for direct contact with the container to hermetically close the main body. In this container, the main body and the plate member are directly joined, and therefore, the plate member functions both as a cover of the main body and a supporting member for the accommodating container. The dual function of the plate-like member is advantageous in that the structure is simplified.

However, the direct contact and bonding between the main body of the container and the plate-like member can be easily damaged by the collapse with the other goods or when it falls. As a result, the reliability of the package is degraded, and in addition, when the main body and the plate-like member are separated, the predetermined ambience in the container is not maintained.

Therefore, it is considered that they are strongly bonded in an attempt to prevent the possibility that the main body and the plate member are not separated by the collapse or falling. If, however, they are strongly bonded, they are not easily peeled when a user wants to take the ink jet head cartridge out of the package. More particularly, even if they are peeled, a part of the material constituting the bonding side of the plate member remains in the main body, and therefore, the package is not substantially opened. In another case, if they are peeled with strong force, the ink jet head cartridge is popped out and falls with the possible result of damage thereof.

SUMMARY OF THE INVENTION

Accordingly, it is an object of the present invention to provide an ink jet head cartridge package wherein the accommodating function for hermetically accommodating the contents and the supporting function for supporting the container, are separated, and wherein the high protecting function against the external shock can be accomplished.

According to an aspect of the present invention, there is provided a package for an ink jet cartridge, comprising: an accommodating container having a main body for accommodating the ink jet cartridge and a flange for sealed connection between the main body and a cover; and a holding member having an opening defining member for defining an opening for insertion of the main body therethrough and a flat member cooperable with the opening defining member to sandwich the flange therebetween, said opening defining member having an edge portion contactable to an outer edge of the flange and a peripheral portion around the outer edge.

According to another aspect of the present invention, in order to allow the accommodating container to be easily taken off the supporting member, there is provided a package for an ink jet cartridge, comprising: an accommodating container having a portion for accommodating the ink jet cartridge, a flange integrally molded with the accommodating portion and a covering member connectable with the flange and cooperable with the accommodating portion to form a sealed space; a supporting member having an opening larger than an outer periphery of said accommodating portion, an edge portion of the opening contactable to an outer edge portion of the flange, an opening defining member having an opening peripheral portion, a flat member faced to said opening defining member and a cut in the flat member to permit opening of said package.

According to a further aspect of the present invention, from the standpoint of maintaining proper distribution of the ink in the ink jet head cartridge in the accommodating container, there is provided a package for an ink jet recording cartridge, comprising: an accommodating container having an accommodating portion for containing the ink jet cartridge, a flange integrally molded with the accommodating portion and a covering member connectable with the flange and cooperable with the accommodating portion to form a sealed space; and a holding member having an opening larger than an outer periphery of the accommodating portion, an edge portion of the opening contactable to an outer edge of the flange, an opening defining member having an edge portion of the opening, a flat member faced to the opening forming member, and hooking permitting portion; wherein when said package is hooked through the hooking permitting portion, a head portion of the ink jet cartridge takes a lower position in said container.

According to a further object of the present invention, there is provided a package for an ink jet cartridge, comprising: an accommodating container having an accommodating portion for accommodating the ink jet cartridge, a flange integrally molded with the accommodating portion and a covering member connectable with the flange and cooperable with said accommodating portion to form a sealed space; an opening defining member for defining an opening larger than an outer periphery of the accommodation portion, an edge portion of the opening contactable to an outer periphery of the flange and a peripheral portion of the outer edge; a holding member having a flat member formed with a material separate from said opening defining member and disposed faced to said opening defining member, an opening cut formed in said opening defining member or said flat member; wherein the flange is sandwiched b said opening defining member and said flat member.

According to a yet further aspect of the present invention, there is provided a package for an ink jet cartridge, comprising: an accommodating container having an accommodating portion for accommodating the ink jet cartridge, a flange integrally molded with the accommodating portion, a covering member connectable with the flange and cooperable with the accommodating portion to form a sealed space; an opening defining member for defining an opening larger than an outer periphery of the accommodating portion and an opening edge portion contactable to an outer edge of the flange and a peripheral portion of the opening edge portion; a holding member having a flat member of a material separate from said opening defining member and faced to said opening defining member, a cut formed in one of said opening defining member and said flat member, an information area having a hooking permitting potion, adjacent to said opening defining member; wherein when the package is hooked with the hooking permitting portion, a head of the ink jet cartridge takes a lower position in said container.

According to a further aspect of the present invention, there is provided a package for an ink jet cartridge, comprising: an accommodating container having an accommodating portion for accommodating the ink jet cartridge, a flange integrally molded with the containing portion and a covering member connectable with the flange and cooperable with the accommodating portion to form a sealed state; a supporting member provided with an opening larger than an outer periphery of the accommodating portion and having integrally an opening edge portion contactable to an outer edge portion of the flange, a peripheral portion of the opening edge portion and an opening cut, said opening, opening edge portion, the peripheral portion and the cut constituting an opening region, and a folded flat region faced to said opening region; wherein said peripheral portion and the flat region corresponding thereto are bonded, and the flange is sandwiched by the opening edge portion and the folded flat region.

According to a further aspect of the present invention, there is provided a package for an ink jet cartridge, comprising: an accommodating container having an accommodating portion for accommodating the ink jet cartridge, a flange integrally molded with the accommodating portion and a covering member connectable with the flange and cooperable with said accommodating portion to form a sealed space; a supporting member provided with an opening larger than an outer periphery of the accommodating portion and having integrally an opening edge portion contactable to an outer edge portion of the flange, a peripheral portion of the opening edge portion and an opening cut, said opening, opening edge portion, the peripheral portion and the cut constituting an opening region, a folded flat region faced to said opening region, and an information member provided with a hooking permitting portion; wherein when said package is hooked with the hooking permitting portion, a head of said ink jet cartridge takes a lower position in said accommodating container.

In the package according to an aspect of the present invention, the hermetical accommodating function for the ink jet recording head cartridge and the supporting or holding function for supporting or holding the accommodating container, are separated. Therefore, the protecting function thereof is good against external shock.

According to another aspect of the present invention, a flange of the accommodating container is sandwiched by facing two surfaces of sheet-like members, and therefore, the accommodating container is assuredly held.

A cut for permitting the accommodating container to be taken out of the holding member, is formed in a holding region of the container, and an information area is placed at a position which is different from them, by which a label or the information on the matter of taking the content out and on the manipulation of the content, can be efficiently given.

When the accommodating container is mounted on the supporting member, the head portion of the ink jet cartridge is at the bottom when it is shown in the shop, the ink in the head is away from the ejection outlets, so that the introduction of the air (bubbles) into the head through the ejection outlets, can be efficiently prevented.

According to a further aspect of the present invention, the cut for permitting the accommodating container to be taken off from the holding member is formed in an opening forming member or a flat member which is a separate member and constitutes a holding region of the accommodating container. The information region is provided in an area other than this region, and therefore, a label and the information on the manner of taking the content out and on the manipulation thereof can be effectively given.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
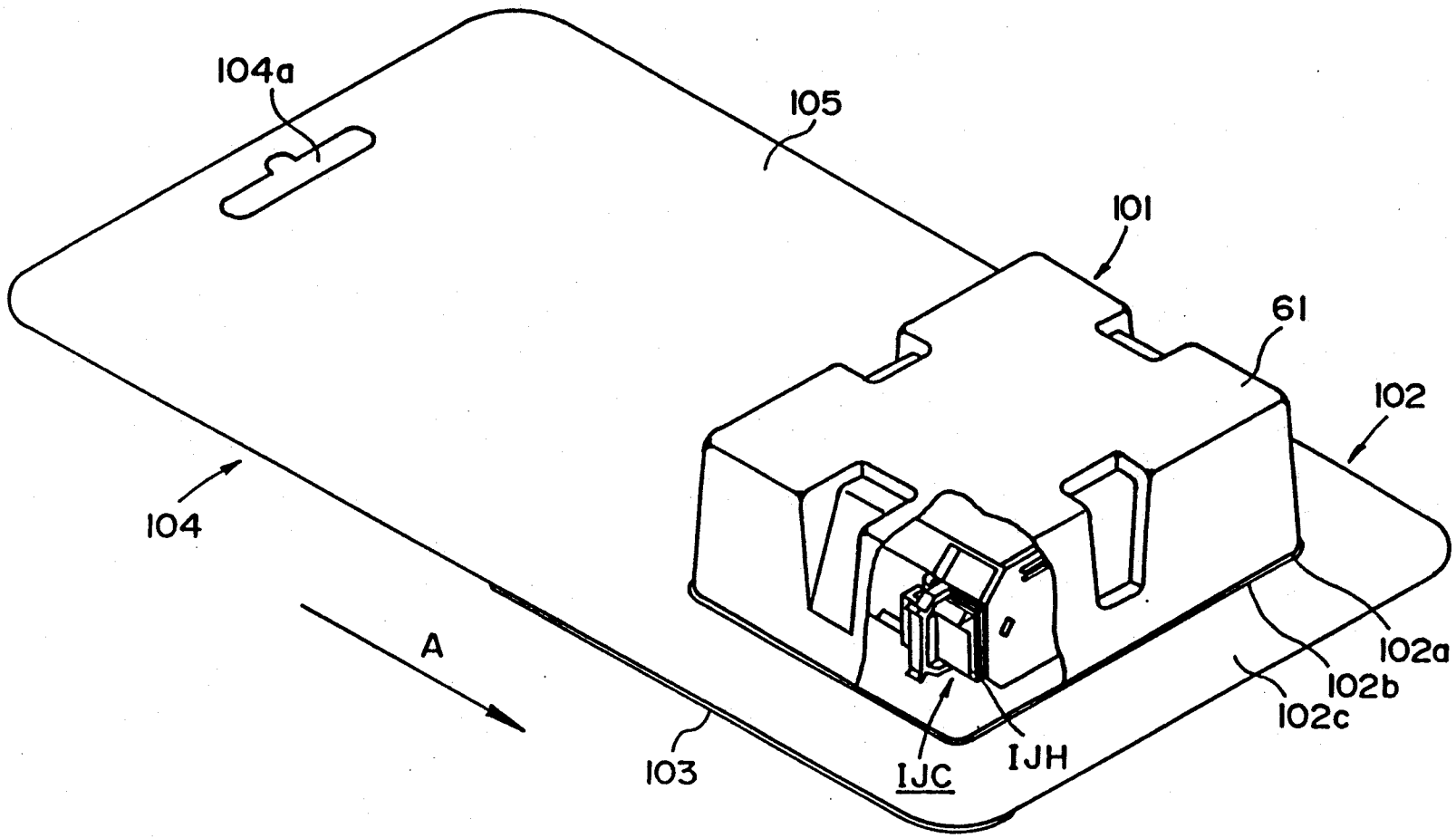
FIG. 1 is a perspective view of a package according to an embodiment of the present invention.

Referring to the accompanying drawings, embodiments of the present invention will be described in detail.

An ink jet cartridge package according to an embodiment of the present invention has the structure shown in FIG. 1, FIGS. 20A, 20B, 20C or 20D.

More particularly, the package for the ink jet cartridge comprises accommodating container 101 having a main body 61 for accommodating the ink jet cartridge. and a flange **61*b* for sealed connection between a body 61 and a covering member 63**; and a holding member 104 having an opening defining member 102 for defining an opening 102*a* for insertion of the main body 61 therethrough, a flat member 103 cooperable with the opening defining member 102 to sandwich the flange 61*b*, said opening defining member 102 having edge portion 102*b* contactable to an outer periphery of the flange 61*b* and a peripheral portion 102*c* around the edge 102*b*.

Figure 13A:
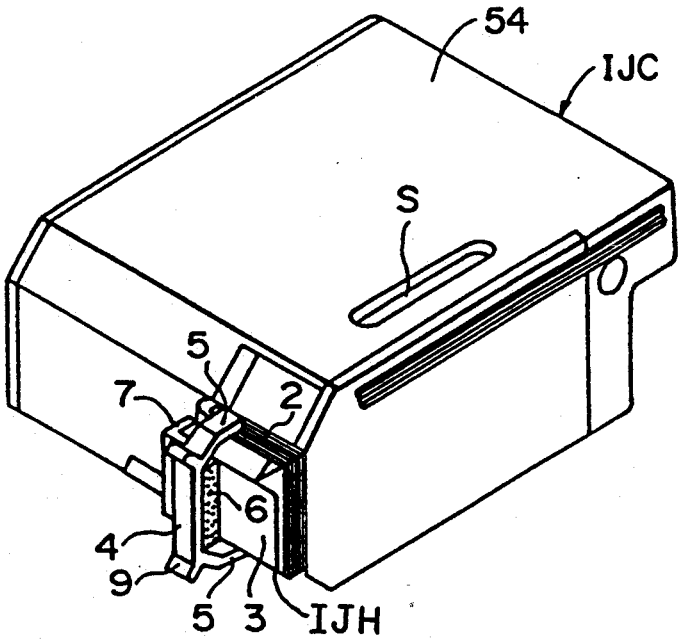
FIGS. 13A and 13B are a perspective view and a partly exploded view of an ink jet cartridge to be accommodated in the package according to the first embodiment.
Figure 13B:
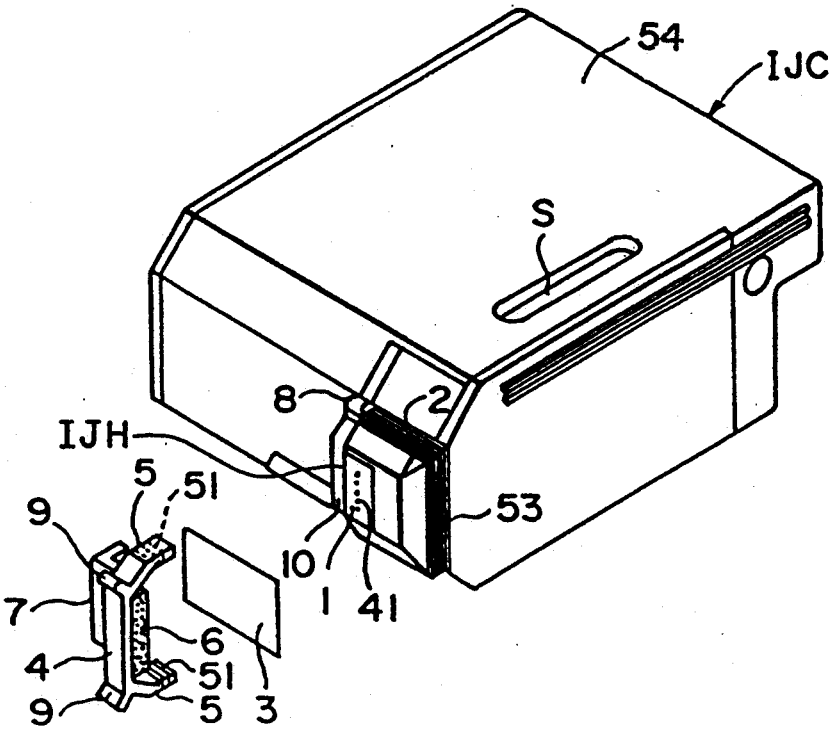

FIGS. 13A and 13B show an ink jet cartridge IJC to be accommodated in the accommodating container 101 depicted in FIG. 1. The head IJH is provided with a sheet for preventing the ink therein from leaking through the ejection outlet and an urging member for urging the sheet.

Figure 5:
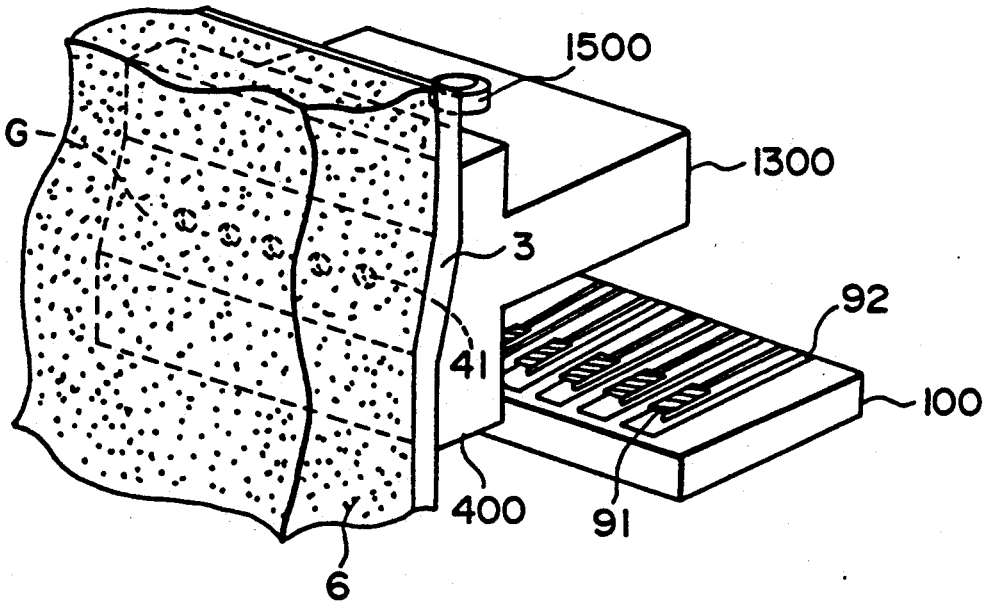
FIG. 5 is a partial exploded view of a recording had according to another embodiment of the present invention.

Referring to FIGS. 13A and 13B, an ink jet cartridge IJC includes an ink container 54 having an ink absorbing material (unshown) provided therein, a supply pipe (unshown) in communication therewith and a recording head IJH in communication with the supply pipe. They are constructed as a unit detachably mountable on the main assembly of the recording apparatus. As shown in FIG. 5, the recording head includes a thermal energy generating element 91, a base plate 100 on which an electrode 92 is formed and an orifice plate 400 provided with plural ejection outlets 41, as shown in FIG. 5.

In this embodiment, a top plate 1300 for forming liquid passages 140 and a plate 400 integrally molded. An opening for permitting monitoring of electric contacts, which will hereinafter be described, is formed on the top portion of the recording head. A base plate 10 of the recording head is made of aluminum plate having an integral positioning portion 8 for engagement with a positioning portion 4010 of the carriage relative to the main assembly of the recording device shown in FIG. 12 to accomplish the positioning thereof relative to the recording apparatus. Depicted in FIG. 13B and designated by a reference numeral 1 is a surface of an ejection side including the orifice plate; 41 designates ink ejectors. In the Figures, an opening for absorbing a backward wave during the recording operation and a dummy nozzle opening are omitted for simplicity. The following descriptions will apply to the ejection side surface with or without such openings.

Grooves 2 are formed in the top surface retracted from the ejection side surface, and in this embodiment, four grooves are formed. Side grooves 53 are formed in a side surface opposite from the base plate 10, and four of such grooves are formed so as t be in communication with the grooves 2. When a large amount of the ink is accumulated in the grooves 2 by ink scattering, the grooves 53 function to guide the ink downwardly. The grooves 2 of the recording head function to retain cap 4 by engagement with grooves 51 using an elastic urging force of arms 5.

Figure 2A:
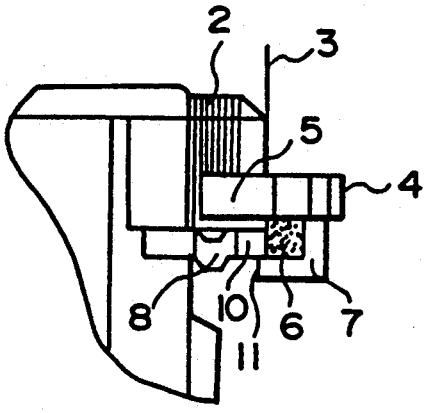
FIGS. 2A and 2B are a top plan view and a side view of the cartridge of FIGS. 13A and 13B.

A sealing sheet 3 has a size enough to entirely cover the ejection side surface 1 of the recording head and can be peeled form the recording head. As shown in FIG. 2A, it has a projection which extends outwardly beyond the recording head. The projection functions as a flange when the sealing sheet 3 is peeled form the recording head. The sheet 3 is mounted on the recording head by a bonding agent between the sheet 3 and the ejection side surface 1. The material of the bonding agent is so selected that it does not adversely affect the ink through the ejection outlets.

The cap 4 shown in FIGS. 13A and 13B has a width corresponding to the ejection side surface 1. It integrally comprises two opposite arms 5 and 5, an elastic member 6 fixed to the inside surface of the main assembly and disposed away form the arms, a portion 7 disposed at a side of the main assembly adjacent the base plate 10 for the purpose of positioning and for the purpose of limiting elastic deformation(reinforcing function), and flanges 9 and 9 usable when the cap 4 is detachably mounted to the recording head. Arms 5 and 5 have the the above-described three grooves 51 in the respective inside surfaces, for engagement with the grooves 2. The number of grooves is not limited if it properly corresponds to the grooves 2 of the recording head.

Figure 2B:
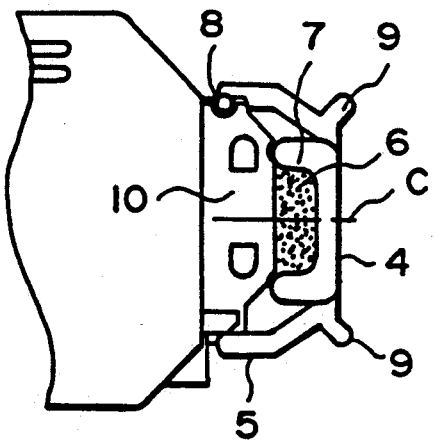

In this embodiment, as will be understood from FIGS. 2A and 2B, the sheet 3 is extended to above the base plate 10, and simultaneously, the elastic member 6 is extended to be faced to the base plate 10. This is done, because the ejection outlets 41 are close to the base plate, and it is preferable that the sealing effect is further enhanced. The portion 7 has such a length that when the cap 4 is mounted on the recording head, it is lightly contacted to the backside of the base late 10. The contact length is approximately 1 mm in this embodiment. With such a small number of parts, the elastic member 6 of the cap is assuredly positioned into the range sandwiching the base plate 10 by the arms 5 and 5 and the positioning portion 7. In other words, the sealing effect for the opening can be accomplished without the above-described problems of the bonding agent.

Figure 3A:
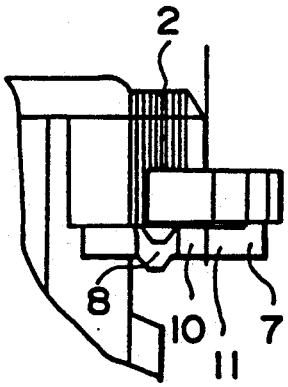
FIGS. 3A, 3B, 4A and 4B are a top plan view and a side view of the cartridge which is a modification of FIG. 2 embodiment.
Figure 3B:
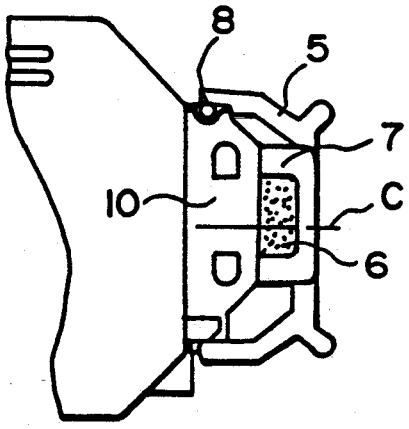

FIGS. 3A and 3B show a structure wherein the urging region by the elastic member is concentrated on the ejection outlets. In order to accomplish this, the portion of the elastic member 6 of FIG. 2 which is faced to the base plate 10 is omitted. In this embodiment, the portions 7 and 7 function as the elastic deformation limiting portion. By the structure, the urging force of the cap 4 is effective to seal the entirety of the ejection outlets with uniform pressure distribution, and therefore, it is preferable. In the structure of FIG. 3, the structures of the portion other than described above, are similar to FIGS. 1 and 2.

Figure 4A:
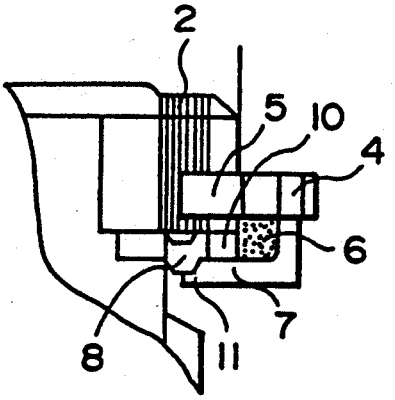
Figure 4B:
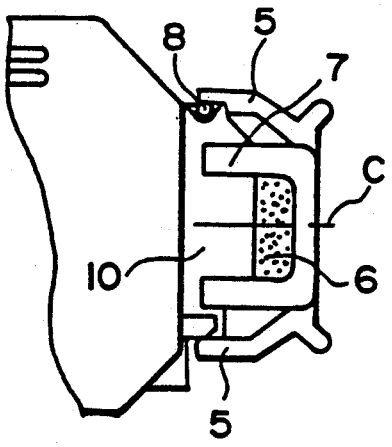

FIGS. 4A and 4B shows the structure wherein the portions 7 and 7 of FIG. 2 are further extended so that the capping member 4 has an additional function, that is, a guide when the cap member 4 is mounted in the recording head. In this embodiment, they have the length equivalent to that of the arms 5 and 5, and therefore, upon the cap mounting, the portions 7 and 7 are not mountable unless they are correctly positioned at the backside of the base plate, and therefore, the operability is further enhanced when the sizes of the cap 4 and the elastic member are equal.

The engagement between the grooves 2 and 51 will be briefly described. Upon the mounting, the flanges 9 and 9 are gripped so that they are moved toward each other, then the arms 5 and 5 elastically deform so that the clearance therebetween expands. With this state, the recording head is inserted between the arms 5 and 5 of the cap, and then, the flanges are released, by which the engagement between the grooves 2 and 51 is accomplished. At this time, if there is a positional deviation by the amount of one or more grooves, the balance can be easily adjusted between the elastic urging force of the arms and the elastic force due to the deformation of the elastic member 6 if the depth of the grooves is not more than 1 mm. When the same numbers of grooves are engaged, the entire balance becomes good, and therefore, the sealing is enhanced, and in addition, the pressure distribution is made proper. Therefore, the sealing is assured. The material and dimensions of the elastic member 6 may be selected under the condition that when the grooves 2 and 51 are engaged, the sheet 3 is press-contacted to retain the hermetical sealing.

In this embodiment, the sheet 3 is made of flexible sheet having a thickness of 12–30 microns and made of polyethylene terephthalate or tetrafluoroethylene resin or the like. The elastic member is made of sponge having a thickness of approximately 3 mm. The usable materials include silicone sponge, polyurethane sponge or the like. However, the usable materials and the structure of the cap or the like are not limited to those described in the foregoing.

Figure 6:
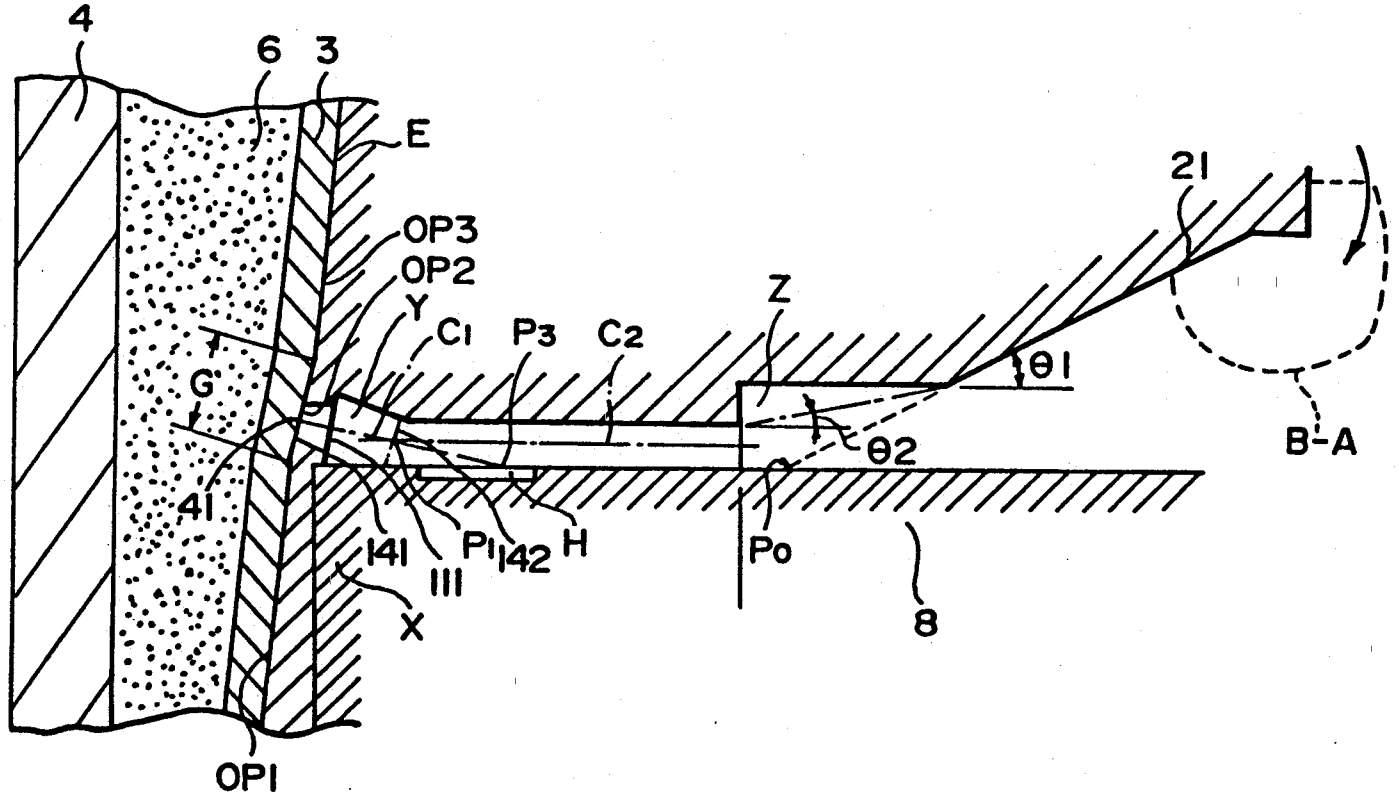
FIG. 6 illustrates a cross-section of a recording head of FIG. 5.

In FIGS. 5 and 6, a slanted surface G of 70 microns provides a step of approximately 30 microns between the upper surface and the lower surface. In this embodiment, the assured sealing is accomplished due to the stepped surface.

As will be understood from FIG. 6, a liquid chamber has a region Z in communication with a liquid passage and expanding toward an ink receptor, a slanted surface 21 extending from the ink receptor to the region Z. An extension of the slanted surface reaches a surface position Po of the base plate 3 of the ejection energy generating means H of the liquid passage faced to the region. In this embodiment, the slanted surface 21 forms an angle $\theta 1$ of 22 degrees relative to the center line C2 of the ink passage and an extension thereof, and the angle of the left and right inner wall surfaces forms an angle of approximately 15 degrees.

Because of the presence of the expanding region Z, fine bubbles can be concentrated to the region. Further, the concentrated bubbles are retained in a region different from and away from an extension of the liquid passage having the ejection energy generating means H. Therefore, even if the size of the bubble is increased, it can be guided along the slanted surface 21 away from the liquid passage, and therefore, the occurrence of improper recording can be significantly delayed. In addition, extension of the slanted surface reaches the ejection energy generating means disposed side in the liquid passage.

Therefore, even if some shock moves the bubble existing in the liquid chamber, and if it tends to enter the liquid passage, it is obstructed by the ejection energy generating means disposed side Po at which an extension of the slanted surface abuts. Therefore, the improper recording which can stem from introduction of the bubble can be effectively prevented. In the ink jet recording head, the angle is not limited to this. However, the angular limitation in the above structure will enhance the advantageous effects.

The structure which will be described hereinafter is particularly effective when a suction recovery is used, but is also effective when a pressurizing recovery is used. Designated by a reference numeral 141 is a symmetrical trapezoid configuration of the liquid passage adjacent the orifice plate side end; and 111 designates a symmetrical trapezoid configuration of an inside opening of the orifice plate contacted thereto. Also, the ejection opening has a symmetrical trapezoidal configuration. In this embodiment, the ink passage from the liquid passage to the ejector has a symmetrical trapezoidal cross-section. A long side of the trapezoidal configuration is adjacent the ejection energy generating means, and therefore, the dispersion of a bubble if any toward the entire inside surface is made non-uniform, and therefore, the created or introduced bubbles are concentrated to the short side of the trapezoidal configuration. In addition, the discharging paths of the bubbles upon recovery operation can be concentrated, and therefore, the bubble ejecting effects can be further enhanced Since the short and long sides of the trapezoid of the ejection outlet correspond to the short and long side of the trapezoid of the passage, respectively, the generation of the eddy current upon the recovery operation can be prevented, and therefore, the bubble discharging effect can be stabilized. In this embodiment, as a most preferable configuration, there are a first region (the liquid passage from a line P1 form the openings 141 and 111) of the liquid passage in the form of the symmetrical trapezoid adjacent the ejection outlets, and a second region (from the opening 111 to the opening 141) reducing while maintaining the symmetrical trapezoidal configuration and connecting to the symmetrical trapezoid of ejection outlet, the bubbles can be assuredly removed without disturbances or eddy current of the ink. In this embodiment, the first and second regions are symmetrical relative to a plane (line C1) formed by connecting the centers of the symmetric sides of the liquid passage on FIG. 6, and therefore, the pressure distribution during the recovery operation can be uniform, by which the occurrence of eddy currents can be significantly reduced. Since an extension of the line C1 reaches a point P3 on the surface of the heat generating element H, the ejection energy is efficiently used.

According to this embodiment, the top plate forming the common liquid chamber and the ejection outlet forming member are made integral, and the structure is simplified by use of the liquid passage forming member having the stepped portion for engagement with the substrate and a pressing member for pressing it from above the liquid passage of the liquid passage forming member in a direction in which the liquid passage is arranged (line pressure) while it is engaged with the leading portion of the basc plate. Despite the simple structure, the inconveniences arising from the production of the bubbles are not experienced, and therefore, god recording operation is possible.

In this embodiment, the orifice plate has different angles OP1, OP2 and OP3 (inflection points H and I). The ejection direction of the liquid droplet is stabilized to the direction of an extension of line C1 which is perpendicular to the slanted surface (OP2), and therefore, the recording surface is perpendicular to the line C1. In this embodiment, when the recording head is operated, the recording medium moves from the bottom to the top in the Figure. The orifice plate has a cross-section with a step having small inclination at the side having the ejection outlet, and therefore, without particular parts inside or outside of the cap, the assured cleaning is possible upon wiping operation, despite the possible change of the pressure contact. Upon the contact of the cap to the head surface, the air inside the cap can externally escape, and therefore, the meniscus of the ink can be prevented from retraction. Therefore, the improper ejection of the ink and various problems resulting therefrom can be solved with the simple structure maintained.

The height of the region Z in FIG. 6 is preferably equal to or smaller than the height of the liquid passage in FIG. 6. An angle $\theta 2$ provided by the region Z is approximately 10 degrees. The angle is preferably not more than one half the angle $\theta 1$ of the slanted surface 21.

As will be understood from FIG. 6, the surface of and adjacent the ejection outlets are assuredly sealed by the sheet 3, and the sealed state is assuredly maintained by the elastic deformation of the elastic member 6, and therefore, better advantages are provided than the prior art.

Figure 7A:
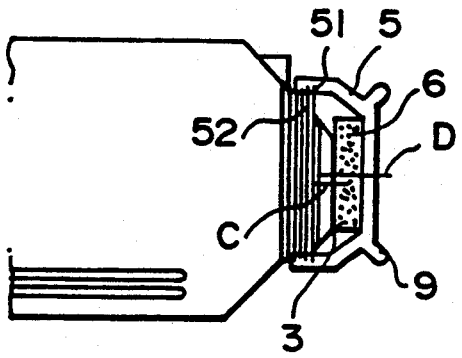
FIGS. 7A, 7B and 7C, FIGS. 8A, 8B and 8C and FIGS. 9A, 9B and 9C are side views, front views and top plan views of other embodiments.
Figure 7B:
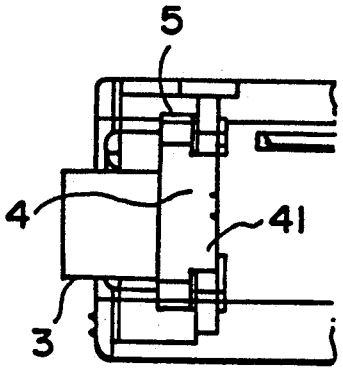
Figure 7C:
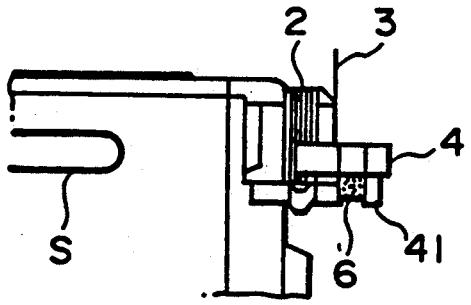

In the embodiment shown in FIG. 7, the portions 7 and 7 of FIG. 2 are omitted.

Therefore, that portion of the elastic member 6 which is urged to the base plate 10 is assuredly urged by an extension 41 of the main body of the cap. With this structure, the cap member is simplified, and in addition, it is advantageous that the cap is mounted or dismounted relative to the recording head by sliding it along the grooves 51.

Figure 8A:
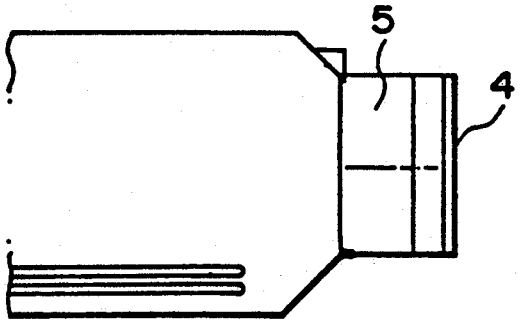
Figure 8B:
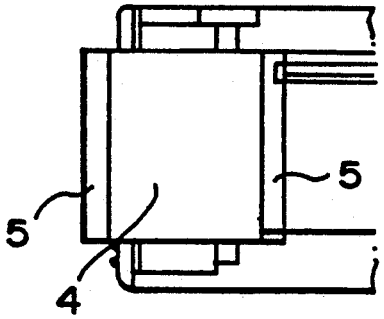
Figure 8C:
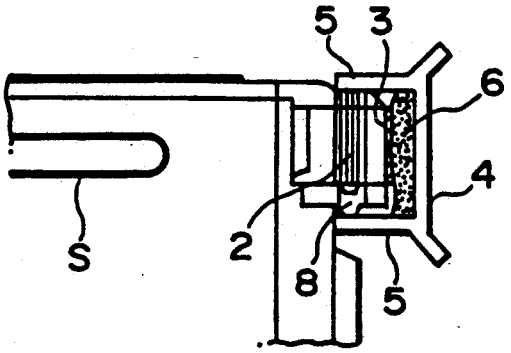

In FIG. 8C, the cap is so constructed that it is engaged with the positioning portions 8 and 8 of the base plate 10 and the groove 53. The seal 3 is only in the cap. Then, the mounting accuracy is enhanced by using the positioning accuracy between the recording head and the recording apparatus.

Figure 9A:
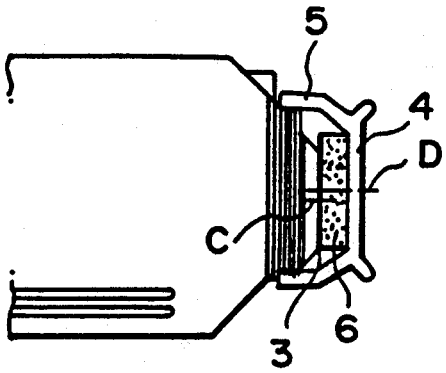
Figure 9B:
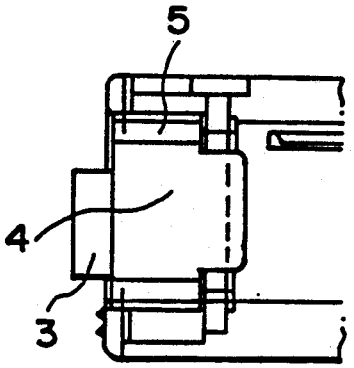
Figure 9C:
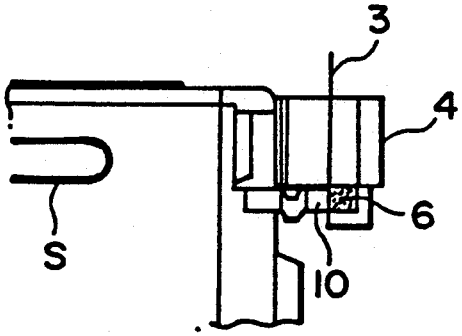

In FIGS. 9A–9C, the width of the cap of FIG. 2 is enlarged to cover the entirety of the front surface of the recording head having the ejection side surface 1 of the recording head, by which the mounting is stabilized.

Figure 10:
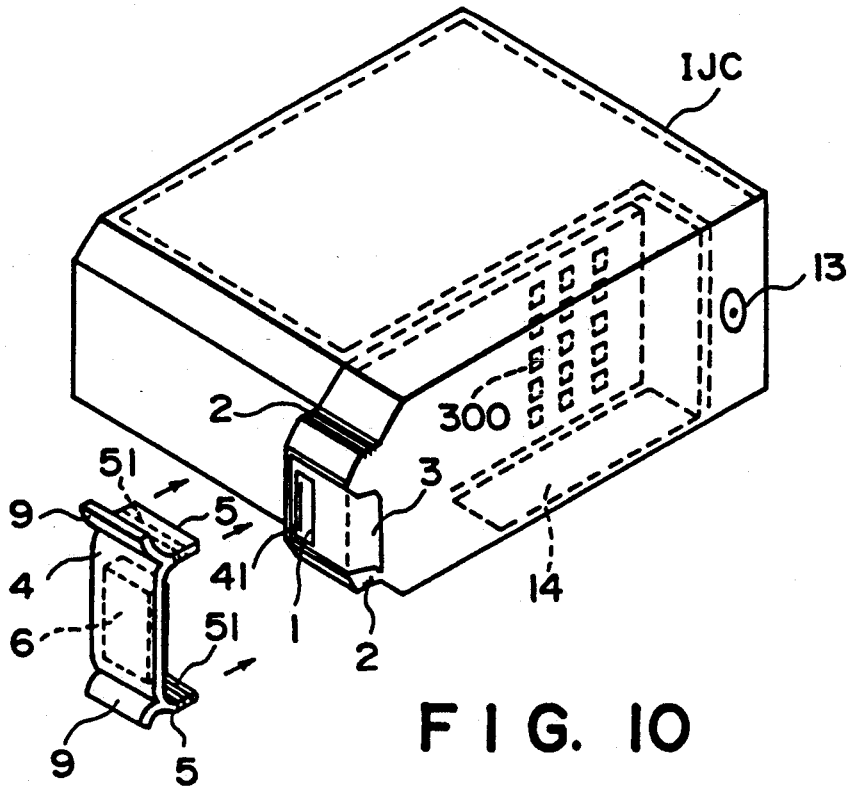
FIGS. 10 and 11 are perspective views of ink jet recording head cartridges according to modified embodiments of the present invention.

FIG. 10 shows an embodiment wherein portions 7 and 7 of FIG. 9 embodiment are removed. With this large size, the structure for improving the positional accuracy is not required. Only by mounting relative to the recording head, the stabilized state is established.

Figure 11:
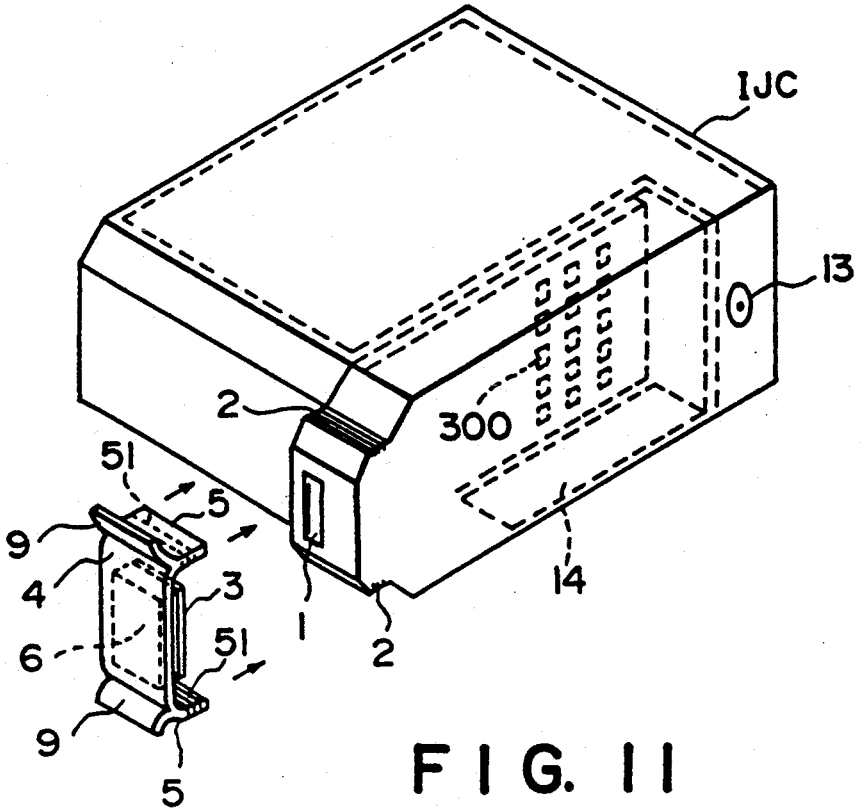

FIG. 11 shows the capping member having the above-described seal 3 integrally formed on the elastic member of the cap, a recording head using it and a method of keeping them. This embodiment is effective where after the recording head is taken out of a carrier which will be described in conjunction with FIG. 12, the capping member is mounted again.

Figure 12:
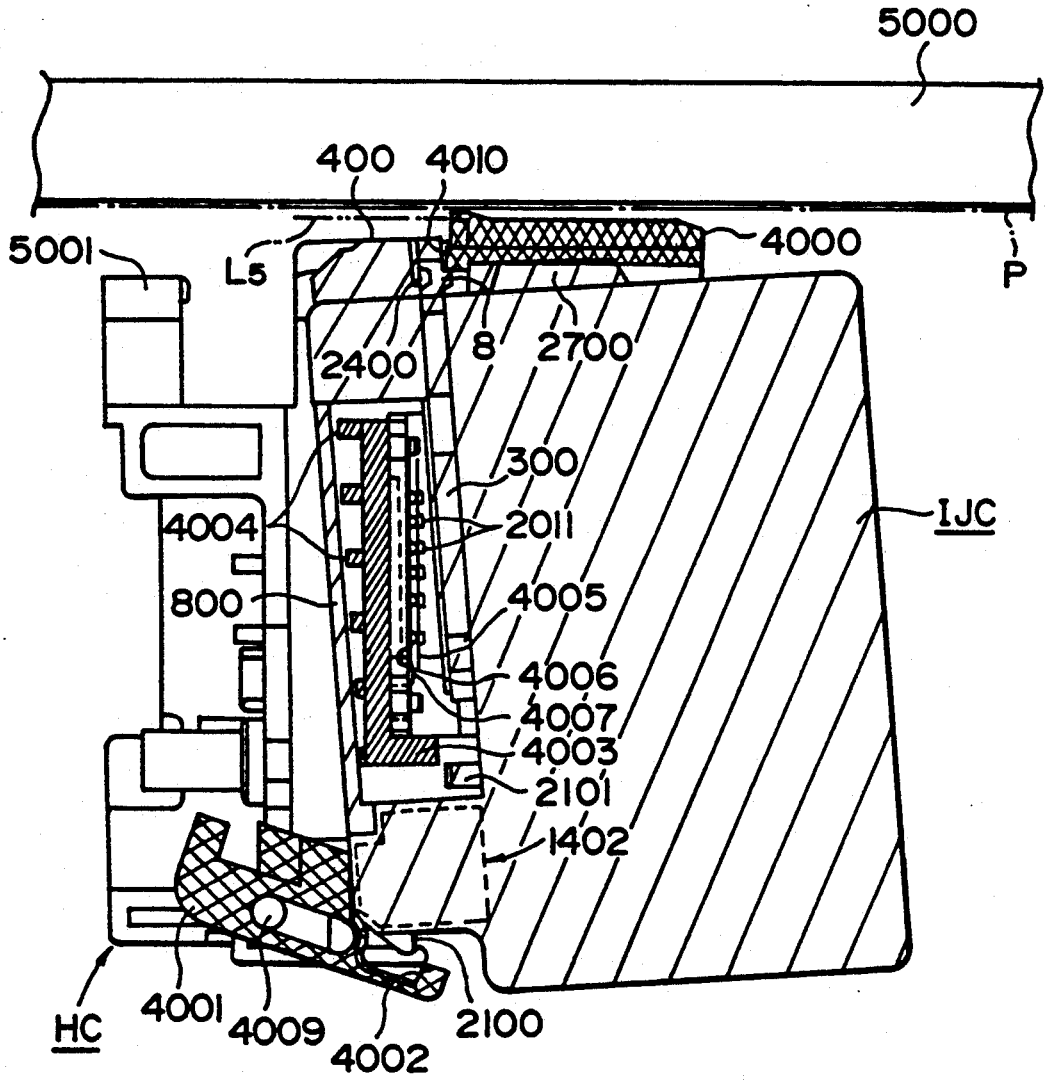
FIG. 12 is a partial sectional view illustrating mounting and dismounting of the recording head relative to the recording apparatus.

As will be understood from FIG. 12, the ink jet recording cartridge is such that the ink accommodation region percentage is large. A front portion of the ink jet unit is slightly ejected from the front surface of the ink container. The ink jet cartridge IJC is fixedly supported by a carriage HC positioning means (which will be described hereinafter) mounted on the ink jet recording apparatus main assembly IJRA and electric contacts. It is detachably mountable to the carriage HC.

In FIG. 12, designated by a reference numeral 5000 is a platen roller for guiding the recording medium P from the bottom to the top in this Figure. The carriage HC is movable along the platen roller 5000. It comprises a front plate 4000 (having a thickness of 2 mm) adjacent to the platen and adjacent the front side of the ink jet cartridge IJC, an electric contact supporting plate 4003 having a flexible sheet 4005 with pads 2011 corresponding to the pads of the wiring board 300 of the cartridge IJC and rubber pad sheet 4007 for producing elastic force for urging the pawl 2100 from the backside, and a positioning hook 4001 for fixing the ink jet cartridge IJC to the recording position. The front plate 4000 has two positioning projection surfaces 4010 corresponding to the projections 2500 and 2600 of a cartridge supporting member 300. After the cartridge is mounted, they receive the forces perpendicular to the projection surfaces 4010. Therefore, plural reinforcing ribs (not shown) extending in the same direction as the perpendicular force at the platen roller side of the front plate. The ribs are projected toward the platen roller by a small amount (approximately 0.1 mm) beyond the front position L5 upon the mounting of the cartridge IJC, and function as projections for protecting the recording head.

The supporting plate 4003 has plural reinforcing ribs 4004 extending in the direction perpendicular to the direction of the above-described ribs. The height thereof reduces toward the hook 4001 from the platen side. It also has a slanting function upon the mounting of the cartridge.

In order to stabilize the electric connection, the supporting plate 4003 has two positioning surfaces 4006 corresponding to the projection surfaces 4010 so that the cartridge receives the force in the direction opposite from the direction of the force to the cartridge by the two positioning projection surfaces 4010, so that a pad contact region is formed therebetween, and the amount of deformation of the projections of the rubber sheet 4007 corresponding to the pad 2001 is confined to a uniform amount. When the cartridge IJC is fixed at the recording position, the positioning surface is contacted to the surface of the wiring board 300. In this embodiment, since the pads 201 of the wiring board 300 are distributed so as to be symmetrical relative to the line L1, the amount of deformation of each of the projections of the rubber sheet 4007 is made uniform to stabilize the contact pressure of the pads 2011 and 201. The distribution of the pads 201 in this embodiment is two lines at the top and bottom, and two vertical lines.

The hook 4001 has an elongated whole engageable with a fixed shaft 4009 and the ink jet cartridge IJC is positioned relative to the carriage HC by rotating in the counterclockwise direction in the Figure using the space of the elongated slot and moving to the left along the platen roller 5000. The movement of the hook 4001 ma be made in any known way, but using lever is preferable. In any case, upon movement of the hook 4001, the cartridge IJC moves toward the platen, and the positioning projections 2500 and 2600 move to the position where they are engageable with the positioning surface 4010 of the front plate. By the leftward movement of the hook 4001, the hook surface 4002 at 90 degree angle is contacted to the 90 degree angle surface of the pawl 2100 of the cartridge IJC, and the cartridge IJC is rotated in the horizontal platen about the contact portion between the positioning surfaces 2500 and 4010, until the pads 201 and 2011 are brought into contact. When the hook 4001 is engaged at a predetermined position, that is, the fixed position, the simultaneous establishment is reached in complete contact between the pads 201 and 2011, the complete surface contact between the positioning surfaces 2500 and 4010, in the surface contact between 90 degree surface 4002 and the 90 degree surface of the pawl and in the surface contact between the wiring board 300 and the positioning surface 4006, so that the cartridge IJC is correctly retained on the cartridge.

In this Figure, the 90 degree engaging surface 4002 of the positioning hook 4001 is engaged with the pawl 2100, and the positioning force relative to the carriage applies in a plane parallel with a reference plane.

The present invention is applicable for any combinations of the above-described structures.

Figure 14:
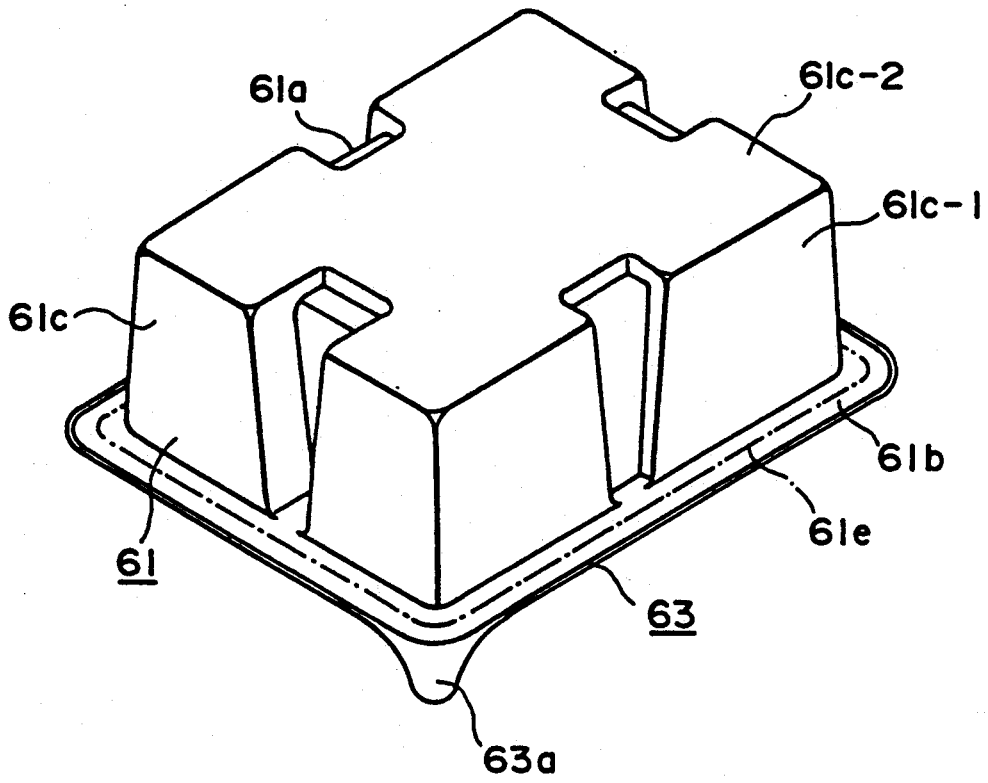
FIG. 14 is a perspective view of an accommodating container (package container) of the ink jet head cartridge according to an embodiment of the present invention after being assembled.
Figure 15A:
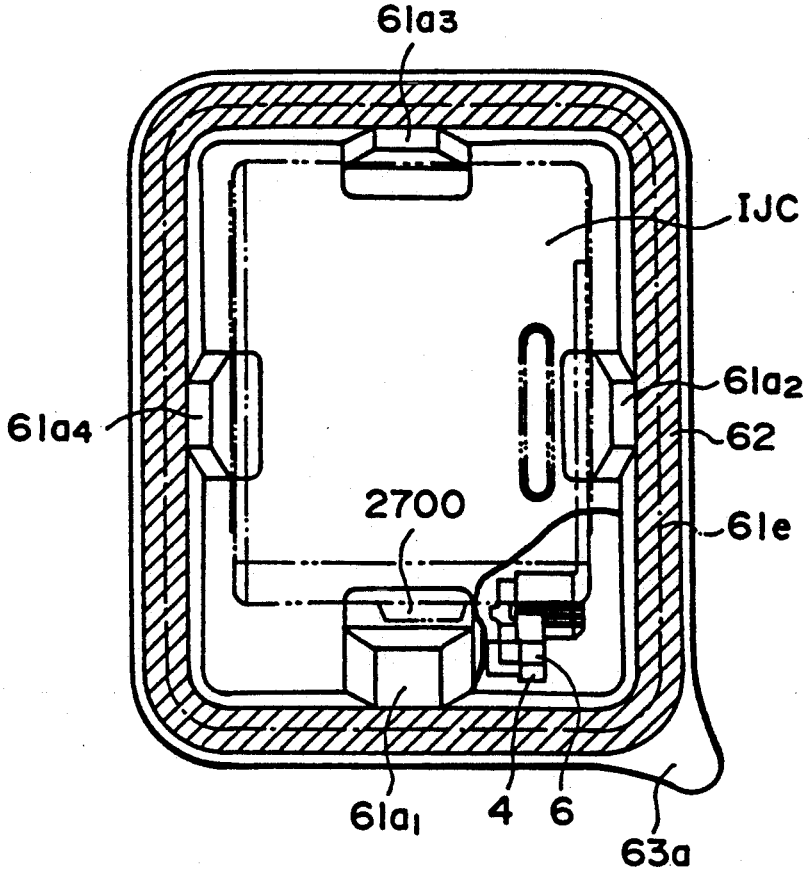
FIGS. 15A, 15B and 15C are a top plan view, a front view and a right side view o an accommodating container according to an embodiment of the present invention.
Figure 15B:
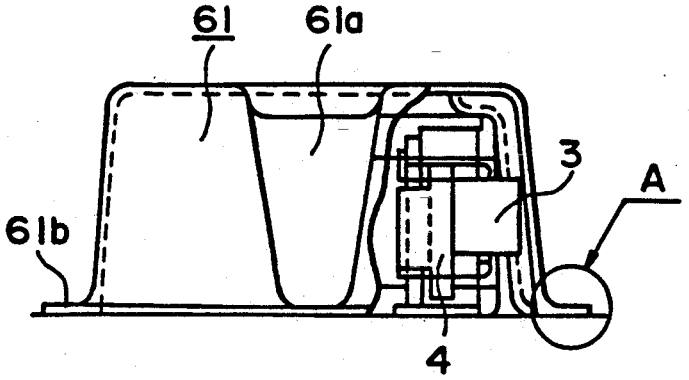
Figure 15C:
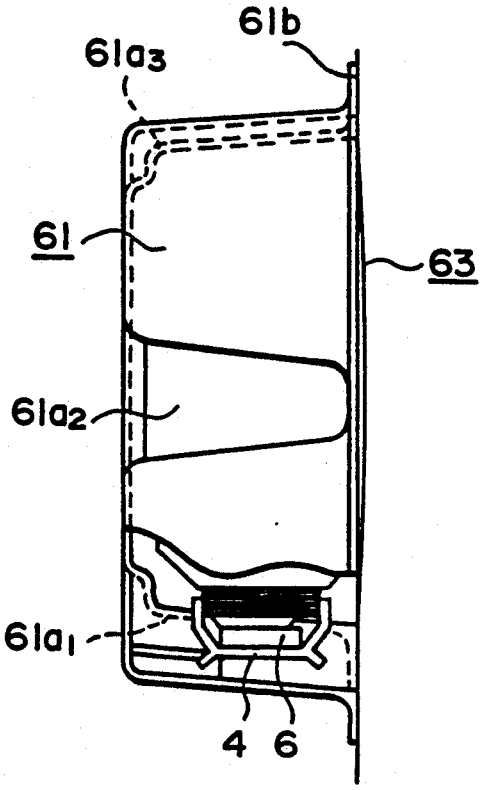
Figure 15D:
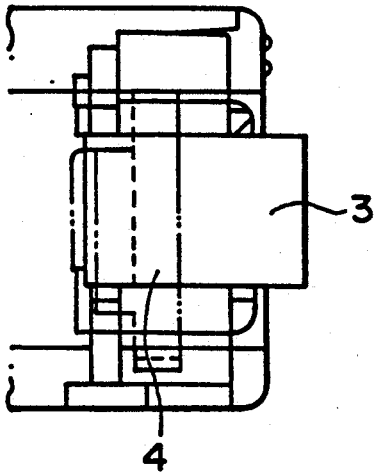
FIG. 15D is a partial enlarged view illustrating the accommodation around the ejection outlets of the ink jet cartridge.
Figure 15E:
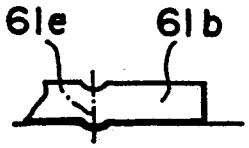
FIG. 15E is a partial enlarged view of a flange of the main body of the accommodating container.
Figure 19:
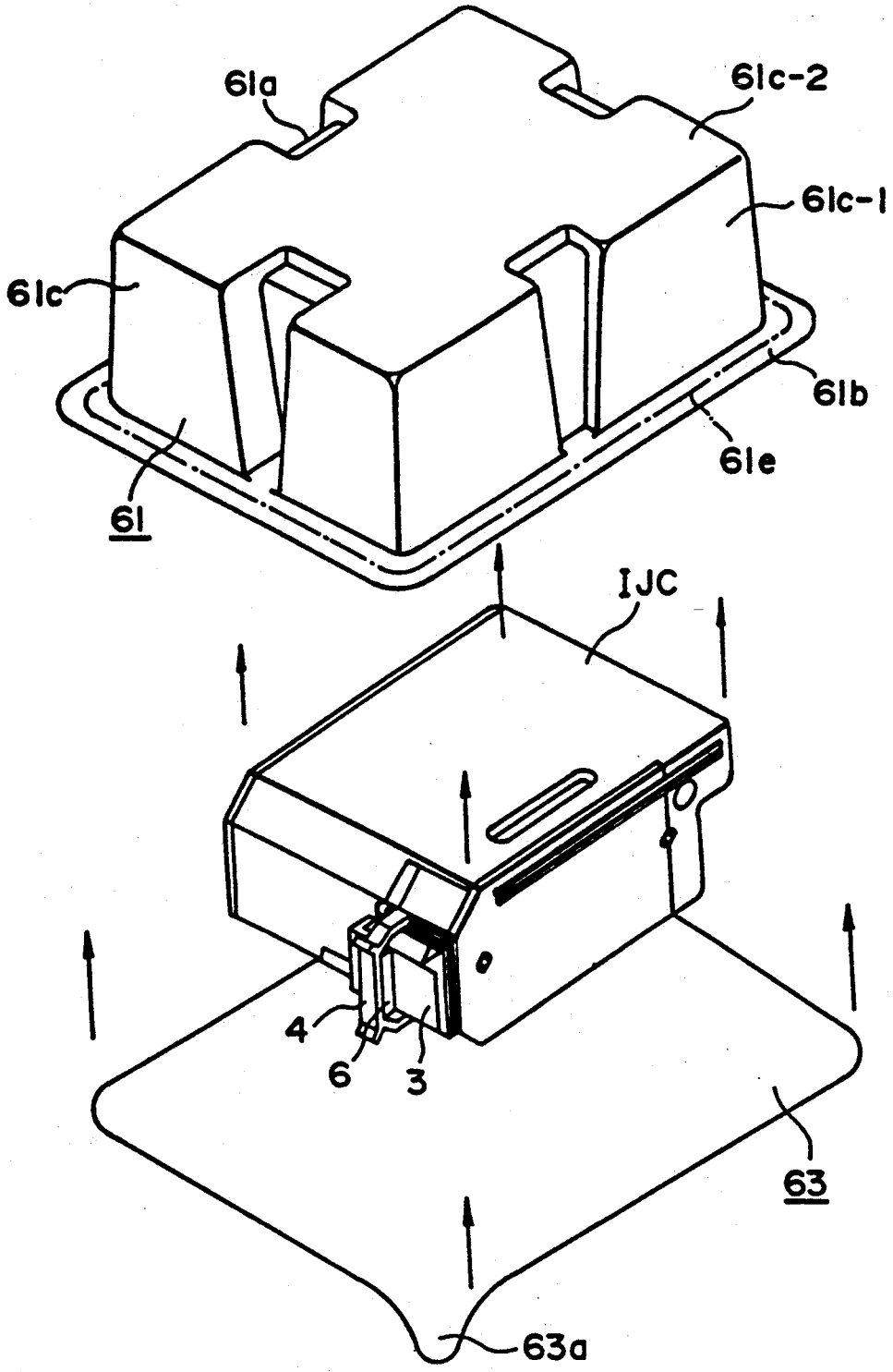
FIG. 19 is an exploded view of an ink jet head cartridge container (package container) according to an embodiment of the present invention.

Referring to FIG. 19, there is shown an accommodating container (package container) of the ink jet cartridge according to an embodiment of the present invention. FIG. 19 is a perspective view thereof before assembly. FIG. 14 is a perspective view after it is assembled. FIGS. 15A, 15B and 15C are a top plan view, a front view and a right side view of the accommodating container according to this embodiment. FIG. 15D is an enlarged partial view illustrating the accommodation of the ink jet cartridge. FIG. 15E is a partial enlarged view of the flange of the main body of the accommodating container.

The package container comprises the main assembly 61 and the covering member 63, and they are connected or joined together to be constituted as the package container.

The main assembly 61 has a wall 61C maintained out of contact with the ink jet cartridge IJC which is the contents of the container package, recesses 61*a* toward the content accommodating region from the wall 61*c* and positioning and fixing the ink jet cartridge IJC, and a flange 61*b* for connection with the covering member 63. The ejection outlets of the ink jet cartridge are maintained out of contact with the wall in the accommodating space. As will be shown in these Figures, the recess 61*a* for receiving the ejection outlets among the four recesses 61*a*1, 61*a*2, 61*a*3 and 61*a*4 has a larger depth, so that the ejection outlets are disposed deep in the recess, and therefore, the ejection outlets are further assuredly protected. Similarly, by doing so, the user is prevented from placing the ink jet cartridge in the wrong manner, since then the cartridge cannot be accommodated in the container.

The wall 61*c* has preferably a sufficient strength by properly selecting the material and the thickness thereof. The thickness of the wall 61*c* ma be selected depending on the material thereof, but it is not less than 0.1 mm, preferably not less than 0.3 mm, further preferably 0.5 mm. The upper limit thereof is 1.2 mm, for example.

On the other hand, the recess 61*a* preferably has a cushion member for buffering or absorbing shock for the purpose of protecting the contents as well as positioning the contents. If the recess 61*a* has the same strength and rigidity as the wall 61*c*, the shock to the wall 61*c* is easily transmitted to the contents, and therefore, the contents are liable to be damaged. From this standpoint, it is preferable that the wall 61*c* is made of relatively thin material, and that it has elasticity. The thickness of the material defining the recess 61*a* is selected depending on the material thereof. For example, it is not more than 0.8 mm, preferably not more than 0.6 mm and further preferably, not more than 0.4 mm. The lower limit is 0.05 mm, for example.

As for the material for the main assembly 61, various resins are usable. The main body 61 is produced by an integral molding with a resin material. The integral molding is preferable from the standpoint of productivity and the producing cost and the like.

For the production of the main body 61 through the integral molding, the various methods such as resin injection molding, vacuum molding or the like may be used. Among them, injection molding using a resin material such as acrylnitrile-butadiene-styrene copolymer resin (ABS resin), polystyrene resin, polypropylene resin, polyethylene, polyethylene terephthalate or the like is preferable since it is easy to control the thickness of the wall 61*c* and the wall defining the recess 61*a*, since the cost is low, and since the desired properties can be easily controlled.

By the provision of the flange 61*b* around the periphery of the main body 61, the junction between the main body 61 and the covering member 63 can be accomplished simply and easily. The flange 61*b* can be formed simultaneously with the other part of the main body 61 during the integral molding. The thickness of the flange 61*b* may be substantially the same as the wall 61*c*. The flange 61*b* is preferably provided with a rib 61*e* for the reinforcement extending along the connecting region 62 between the main body 61 and the covering member 63. The rib 61*e* is projected toward the covering member 63 in FIG. 15, but it may be reversed. However, the former is better from the standpoint that the junction area between the main body 61 and the covering member 63 is assured, and the junction is further assured by the projection.

The corners of the rising portions of the wall 61*c* and the wall defining the recess 61*a* are rounded, by which the cushion effect is improved. The radius of curvature of the rounded portion is preferably relatively large, and is properly selected by one skilled in the art in accordance with the size of the recess 61*a*. For example, it is not less than 2 mm, preferably not less than 3 mm and further preferably not less than 5 mm.

The configuration of the recess 61*a* is properly selected by one skilled in the art so that the ink jet cartridge IJC is properly protected and is effectively positioned in the container. In the shown example, the four recesses are effective to support the ink jet cartridge IJC. This is best from the standpoint of the protection and positioning of the ink jet cartridge IJC, but the number of recesses 61*a* is properly selected by one skilled in the art.

The clearance between the supporting portion of the recess 61*a* for the ink jet cartridge and the ink jet cartridge should not be too large. If it is too large, the ink jet cartridge will be vibrated in the container and therefore may be damaged. If, however, it is too small, the accommodation of the ink cartridge in the main body 61 is worsened, and in addition, the shock is easily transmitted from the wall 61*c*. The clearance may be properly selected in consideration of the structure of the recess 61*a* and the matching between the recess 61*a* and the ink jet cartridge IJC. For example, it is 0.5–3 mm, preferably 0.5–2 mm.

The material and the thickness of the covering member 63 may be properly selected by one skilled in the art in accordance with the weight and the strength of the ink jet cartridge. The covering member 63 may be made of resin material or metal in the form of a film, sheet or plate, or a laminated material including at least one of them. When a laminated covering member 63 is used, on the surface of the covering member 63 which is adhered to the main body (outer layer) the moisture is removed or absorbed by the paper with the result of curling by the influence of the ambience change, more particularly, moisture change. Therefore, the outer surface is preferably made of aluminum, vinylidene chloride, polypropylene or the like having the moisture prevention property as a coating rom the standpoint of durability against the ambience change. In this case, the application of the force in the peeling direction due to the curling deformation can be prevented at the connecting portion 62 between the main body 61 and the covering member 63. The moisture preventing layer may be made of polypropylene from the standpoint of cost and the structure. It preferably has 15–100 microns thickness.

The joining of the main body 61 and the covering member 63 after the ink jet cartridge IJC is accommodated in the main body may be accomplished in various ways. For example, if the main body 61 and the covering member 63 are made of similar or same resin materials, they may be adhered by heat fusing or ultrasonic wave fusing. It is possible that an easy peeling layer may be provided in the region on the bottom plate 63 required for the connection. Using it, the adhering therebetween is possible. In the case of using the easy peeling layer, the covering member 63 may be easily removed form the main body 61, when the package is unpacked therefore, the shock which easily occurs upon the peeling of the covering member 63 can be reduced. Therefore, the possibility of the damage to the ink jet cartridge is further reduced. When consideration is paid to the humidity maintenance (moisture prevention) of the content and the easiness of the unpacking, the easy peeling layer is preferable. As for the easy peeling layer, various hot melt type, polyethylene or everl or the like layer are usable.

For easy handling, it is preferable that a grip 63*a* is provided so as to be used when the covering member is removed from the main body 61. The grip 63*a* is disposed adjacent to the ejection outlets of the ink jet cartridge in FIG. 14. Further preferably, it is disposed as remote as possible from the ejection outlets. The reason is that when the covering member 63 is removed from the main body 61 with the grip 63*a* gripped, the possibility can be avoided that the users finger touches the ejection outlets which are to be particularly protected, and that they are directly contacted.

By proper selection of the material of the package container, the humidity ambience of the contents can be maintained. That is, the contents are protected from the moisture, or the moisture of the contents can be prevented from evaporating externally.

From the standpoints described above, the material of the main assembly 61 has the property of preventing passage of the moisture such as polypropylene or a resin material coated with vinylidene chloride layer or an aluminum layer. Then, the moisture of the contents can be maintained against the ambience. From the standpoint of the manufacturing cost, moldability and productivity, the polypropylene resin is preferable.

Similarly, the material of the covering member 63 is a resin film, sheet or plate, or paper sheet or plate coated with vinylidene chloride layer, or polypropylene having the moisture preventing property. Then, the better durability against the moisture is provided. For the purpose of providing better properties in the cushion effect and moisture maintaining effect, a preferable covering member includes a layer taper coated with aluminum, a layer for the sealing and adhering to the main body (easy peeling layer for example), and a polypropylene layer at the adhering surface (external surface) for the purpose of preventing curling. Particularly, a laminated structure having an aluminum layer and a polypropylene layer as the outermost layer at the non-contact side is preferable from the standpoint of the cost, shock absorbing and moisture ambience maintaining properties.

When a vacuum molding with polypropylene material is used for the main body 61, the rounding at the rising portions of the wall 61*c* and the wall defining the recess 61*a* as described in the foregoing, is preferable from the standpoint of maintaining the moisture in the ambience of the contents and simultaneously the buffering function.

Figure 16:
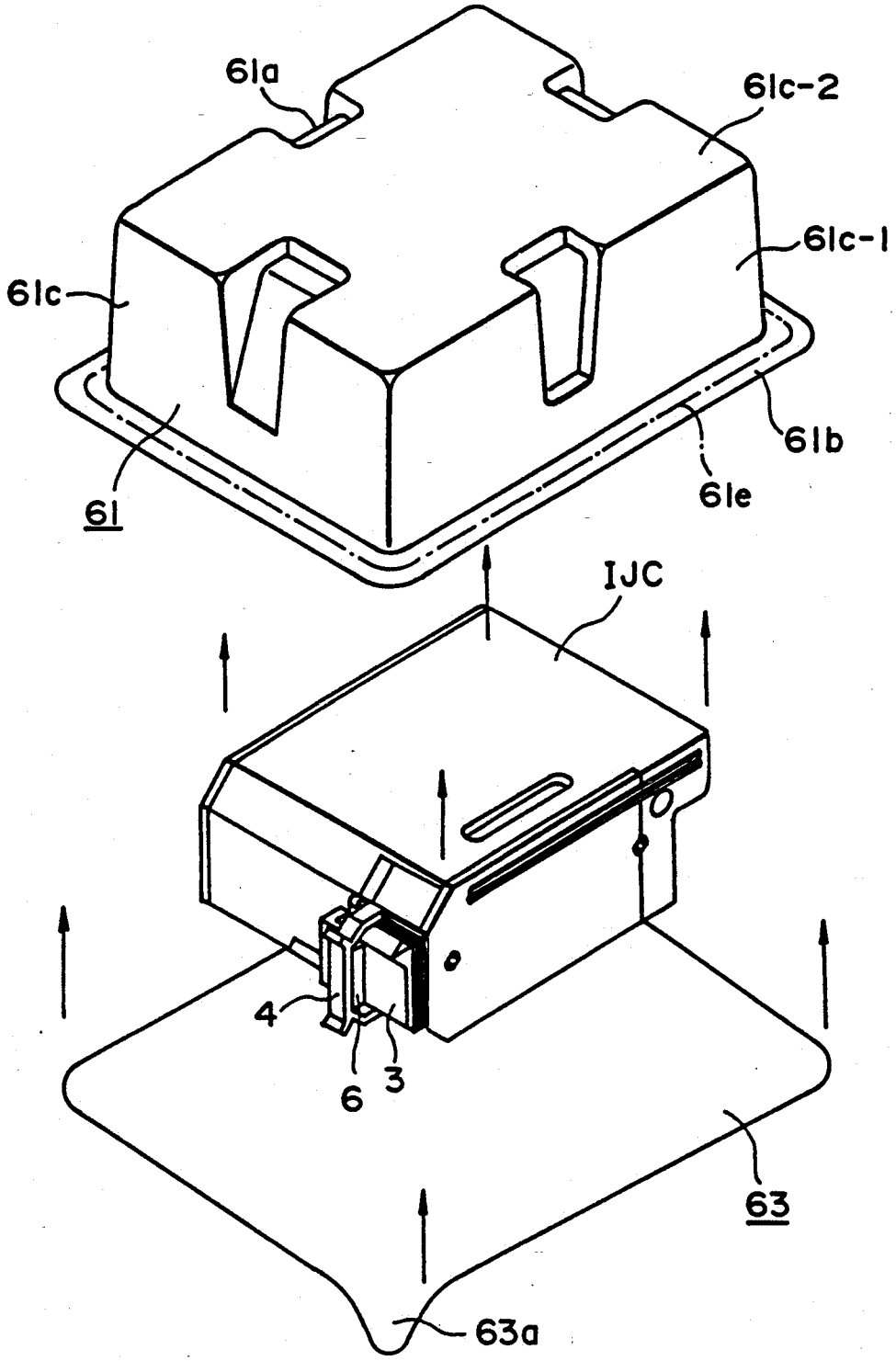
FIG. 16 is an exploded perspective view of an accommodating container (package container) of an ink jet cartridge according to a further embodiment of the present invention.
Figure 17:
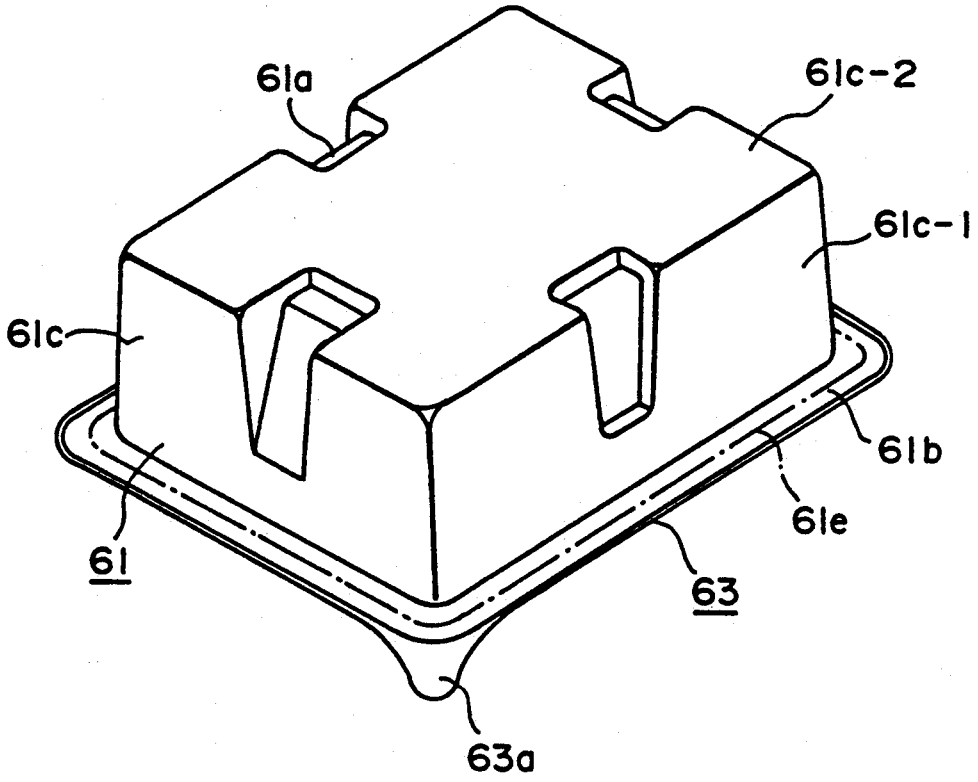
FIG. 17 is a perspective view of an ink jet cartridge accommodating container (package container, after it is assembled.

As shown in FIG. 16, when a mail type molding in which the portion other than the top 61*c*-2 of the blank sheet is extended by vacuum in the direction from the top 61*c*-2 to the bottom (flange 61*b*) of the main body 61 to form the roundings of the wall defining the recesses 61*a*, the side 61*c*-1 of the wall 61*c*, the thicknesses of the various portions can be made uniform without production of pin holes, so that the passing of the moisture can be prevented, and therefore, this is preferable.

When the rounding is not formed in the main body produced by the vacuum molding, thin corners are produced at the boundary between the wall and the wall defining the recess and at the boundary between the wall and the flange. Therefore, pin holes may be produced, and it is easily damaged if it falls. The pin holes may permit penetration of the moisture. By providing the rounding at the boundaries, the occurrence of small thickness portions can be effectively prevented, and therefore, the moisture penetration prevention can be easily accomplished uniformly over the entire main body of the container. In addition, the external portion is strong against shock or falling.

If the material of the main body 61 and/or the bottom plate (covering member) 63 is made of semitransparent or transparent material, the state of packaging of the ink jet cartridge 62 can be observed.

As shown in FIG 19, by the provision of a cover 3 for covering or sealing the ejection outlets formed in the ejection outlet side surface of the ink jet cartridge, the evaporation of the ink through the ejection outlet can be minimized. Therefore, the moisture in the accommodating space can be properly maintained. Therefore, the curling of the covering member 63 can be prevented, and in addition, the ink supply passages from the ink container to the ejection outlets can be maintained under good conditions.

The cover 3 is not limited to the tape-like material, in this invention. However, from the standpoint of easy manipulation (easy peeling, for example), the better keeping of the sealed state of the ejection outlets, non-influence to the size of the ink cartridge (thin material), the cost or the like, the tape-like member is preferable. The material of the cover 3 is polyethylene terephthalate, for example.

In FIG. 19, a confining member 4 for confining the cover 3 to the ink jet cartridge IJC is provided in the ink jet cartridge. As for the preferable confining member 4, a cap having an ink absorbing material 6 at a position corresponding to the ejection outlets is used.

The provision of the confining member 4 is preferable from the standpoint of protection of the ejection outlets which are to be particularly protected, since the user's finger or fingers are prevented from accessing the ejection outlets when the ink jet cartridge IJC is taken out of the package. The confining member 4 is preferably provided such that even if the ink jet cartridge moves within the clearance, it is not contacted to the wall 61*c* of the main body 61.

Figure 18A:
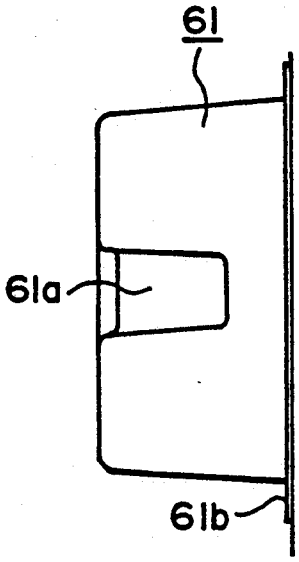
FIGS. 18A, 18B, 18C, 18D and 18E are a left side view, a top plan view, a front view, a right side view and a bottom plan view of an accommodating container according to a further embodiment of the present invention.
Figure 18B:
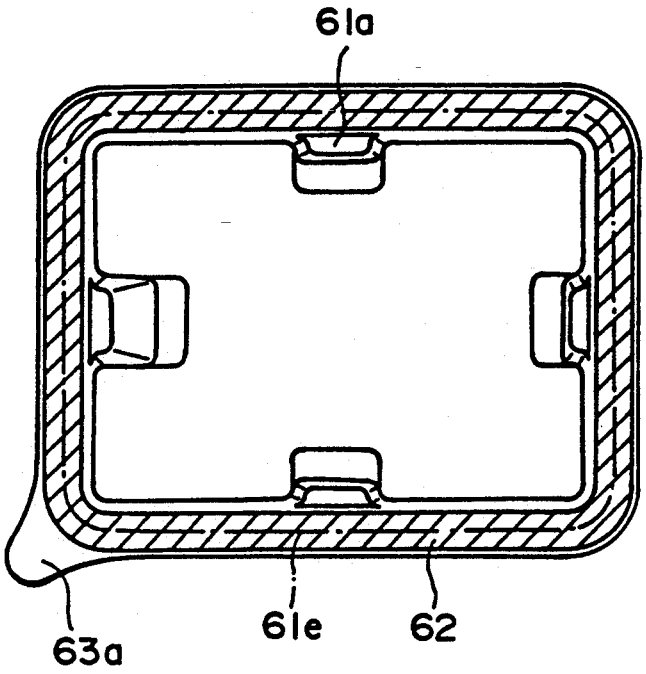
Figure 18C:
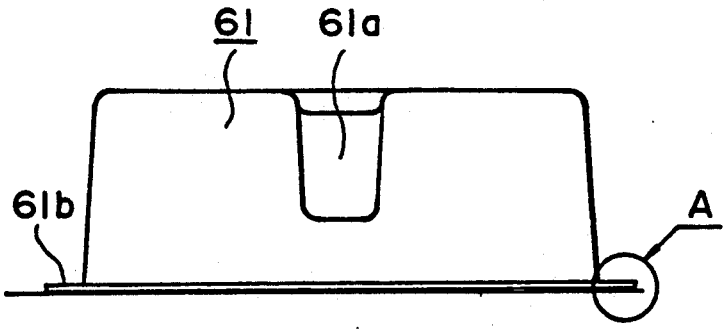
Figure 18D:
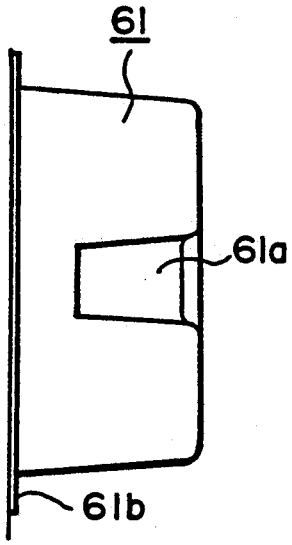
Figure 18E:
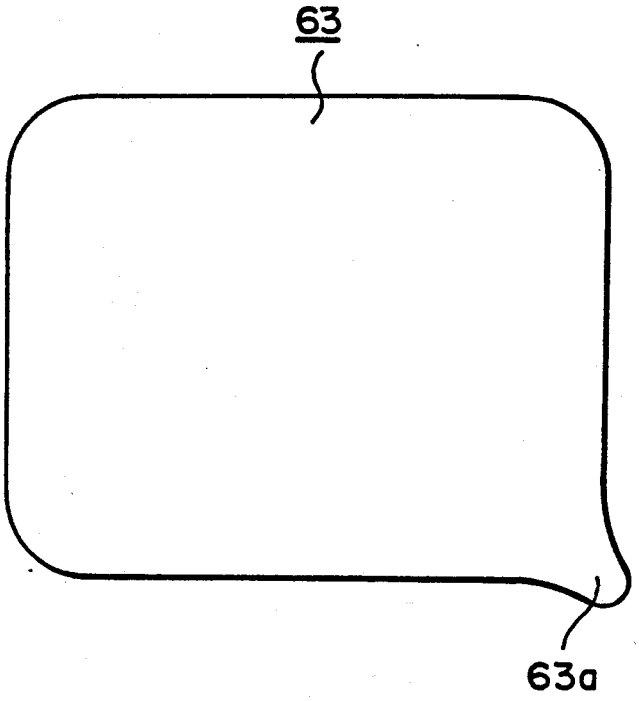
Figure 18F:
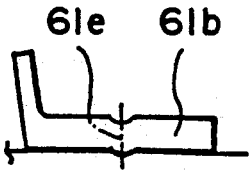
FIG. 18F is a partial enlarged view of a flange of the main body of the accommodating container.

FIG. 16 is an exploded perspective view of an accommodating container (package container) for an ink jet cartridge according to another embodiment of the present invention. FIG. 18 is a perspective view after it is assembled. FIGS. 18A, 18B, 18C, 18D and 18E are a left side view, a top plan view, a front view, a right side view and a bottom view. And FIG. 18F is an enlarged partial view of the flange of the container main body (the front side is different form that of FIG. 15).

This embodiment is the same as the embodiment described in conjunction with FIGS. 19, 14 and 15 except for the configuration of the recess 61*a*. The recess 61*a* of the main body 61 of this embodiment does not reach to the flange 61*b*. The inclination with a predetermined angle is provided to support the ink jet cartridge. From the standpoint of the positioning of the ink jet cartridge in the accommodating space, the former is better, but the objects of the present invention can be accomplished substantially sufficiently with either embodiment.

In this embodiment, the cover 3 is preferably mounted on the head, but it is not necessary for the reasons stated hereinbefore that the present invention includes the structure without the cover 3.

From the standpoint of prevention of evaporation of the water in the ink field in the ink jet cartridge, the provision of the cover 3 is better, but without the cover, the object of the present invention will be accomplished to a satisfactory extent.

On the other hand, a supporting member 104 for supporting the container, as shown in FIGS. 20A, 20B, 20C and 20D, has an opening defining member 102, a flat member 103 and an information area 105. The opening defining member 102 comprises an opening 102*a* for permitting insertion of the main body 61, an edge portion 102*b* of the opening contactable to the outer periphery of the flange 61*b* and a peripheral edge portion 102*c* at an end 102*b*. The flat member 103 is cooperative with the opening defining member 102 to sandwich the flange 61*b* therebetween. The information area 105 is adjacent to the opening defining member 102.

The opening 102*a* permits insertion of the main body 61 therethrough. In order to prevent play of the main body after the insertion, the opening has the size and configuration equivalent to those of the main body 61. Therefore, by the provision of the flange 61*b* around the main body 61 at the accommodation side, the main body 61 is prevented from passing through the opening 102*a*.

In this embodiment, the opening defining member 102 of the supporting member 104, the flat member 103 and the information area 105 are provided by one sheet-like member. The sandwiching of the flange 61*b* of the container 101 is accomplished by two-folding so that the flat member 103 comes to the covering member 63 side of the accommodating container 101 inserted into the opening 102*a* of the opening defining member 102. By doing so, the accommodating container 101 is properly gripped, sot hat the accommodating container 101 is prevented rom falling.

Figure 20A:
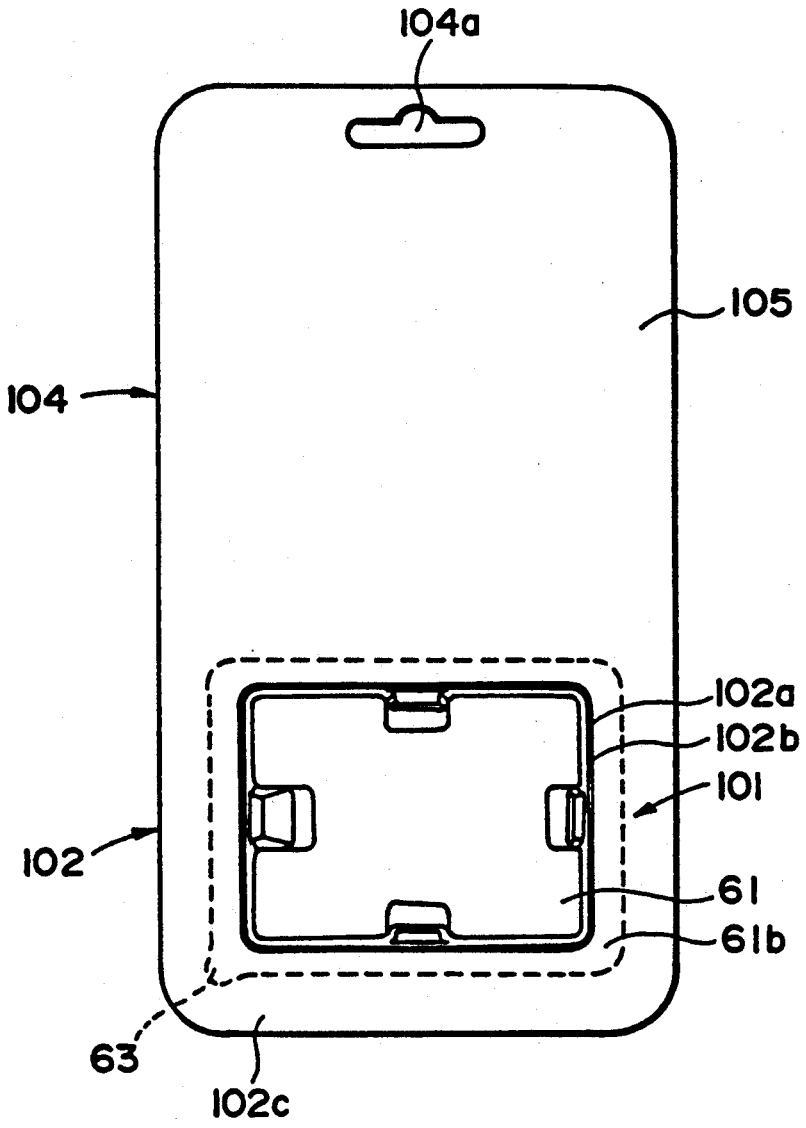
FIGS. 20A, 20B, 20C and 20D are a top plan view, a right side view, a bottom plan view and a side view of the package of FIG. 1.
Figure 20D:
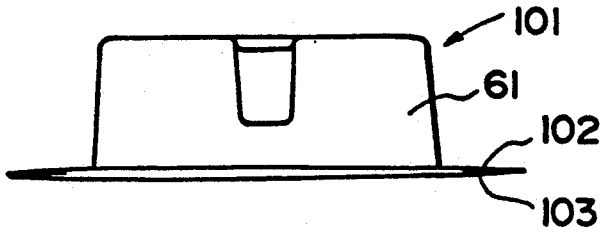
Figure 20B:
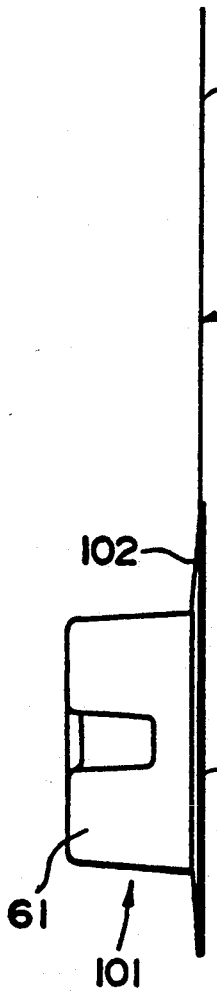
Figure 20C:
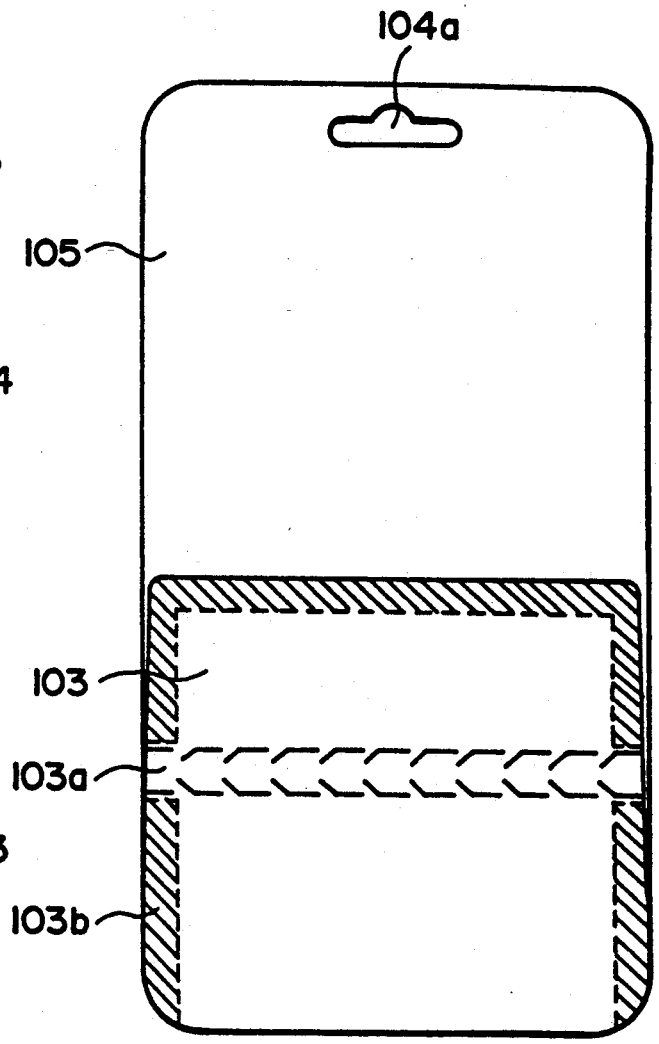

The opening defining member 102 and the flat member 103, as shown in FIG. 20C, are bonded by the bonding region 103*b* (hatched portion) formed between the periphery 102*c* of the opening and the corresponding flat member 103. In this embodiment, the opening defining member 102 and the flat member 103 are folded back and bonded, and therefore, the folded region is not the bonding region 103*b*.

As shown in FIG. 20C, the flat member 103 is slightly reduced toward the end. As a result, the bonding area of the bonding region 103*b* decreases toward the end. In this embodiment, together with the reduction of the area of the flat member 103, the bonding area is reduced. However, irrespective of the flat member 103 configuration, the bonding area can be positively reduced. As shown in FIG. 20C, the grip of the covering member 63 for sealing the main body 61 is projected from the region exclusively occupied by the flange 61*b*, but the bonding region 103*b* is so limited that the grip is not bonded.

As shown in FIG. 20C, the flat member 103 has a cut 103*a* for permitting opening for taking the container 101 from the package. The cut 103*a* is in the form of a zipper which is opened by peeling from one end thereof toward the other end in the form of a stripe.

Where the cut 103*a* provides the zipper-like portion, the bonding region 103*b* excludes the zipper portion.

In FIG. 20C, the zipper formed by the opening cut 103*a* is substantially at the center of the flat member 103. However, the position of the zipper forming portion is not limited to this. For example, it may be adjacent the folding portion of the flat member 103, or adjacent the bonding region 103*b* most remote from the folded portion of the flat member 103.

Where the opening cut 103*a* is disposed substantially at the flat member 103, even if the container 101 is given a shock so that the flat member 103 is pushed, the pushing force is interfered with the bonding region, and therefore, the liability of the cut 103*a* being opened is minimized. Even if the zipper is opened, the pressing force to the flat member 103 separated into two members is divided to the two surfaces, and therefore, the flat member 103 is prevented from peeling from the supporting member.

Particularly, in this embodiment, the bonding area of the bonding region 103*b* is reduced from the folded portion of the flat member 103 to the end. Therefore, the peeling force of the zipper toward the end of the flat member 103 is first large and reduces gradually. Therefore, the zipper is broken by an external force to the container 101, the end portion of the flat member is not easily peeled from the opening defining member 102. On the other hand, the bonding force increases from the zipper toward the folded portion, and it is not easily peeled by an ordinary external force.

The cut 103*a*, is not limited to the structure described above.

Figure 21:
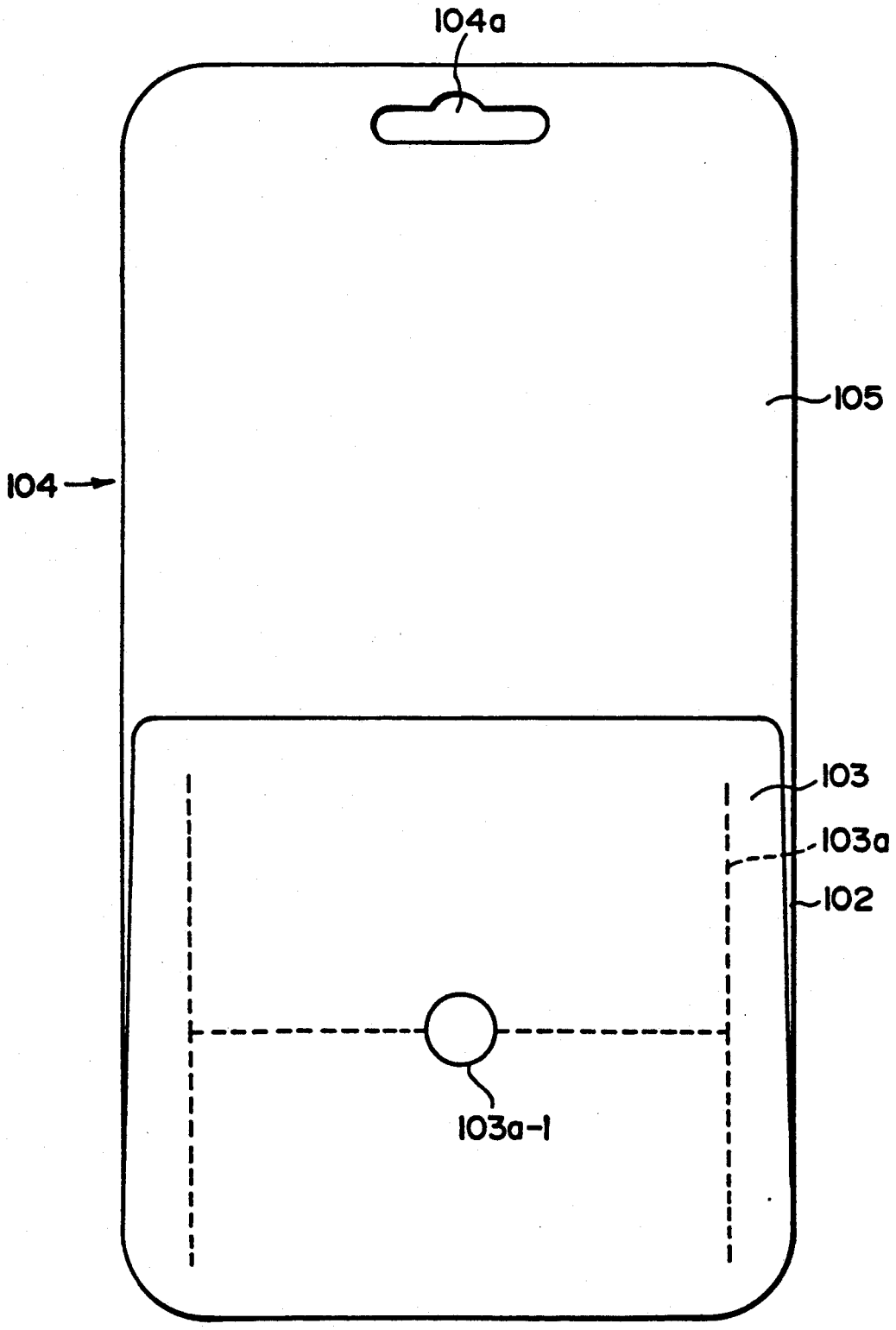
FIG. 21 is a back side view illustrating another example of a cut.

FIG. 21 shows another example. The flat member 103 may be provided with perforations in the form of "H" and with a grip 103*a*-1 for insertion of a finger at a part thereof.

Figure 22:
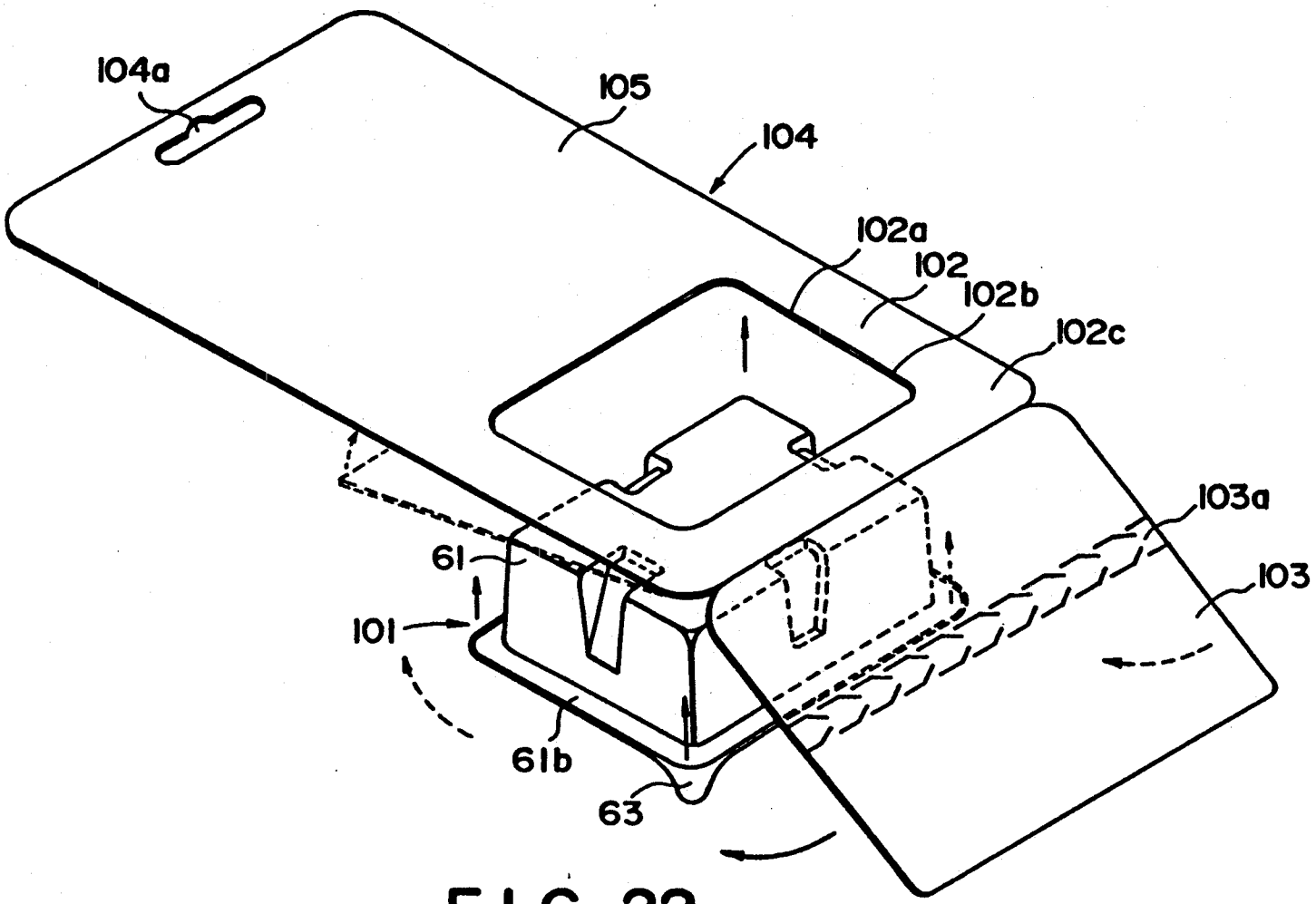
FIG. 22 is an exploded view of the holding member of the package of FIG. 1.

FIG. 22 shows the assembling of the package for the ink jet cartridge. The accommodating container 101 sealed by the covering member 63 is inserted into the opening 102*a* of the opening defining member 102. With this state, the portion of the flat member 103 is folded back, by which the container 101 is sandwiched and fixed from the covering member 63 side. More particularly, the flange 61*b* of the container 101 is sandwiched and fixed by the edge 102*b* of the opening and the region of the flat member 103 corresponding thereto. Thereafter, the bonding region 103*b* shown in FIG. 20C is bonded by heat fusing, by which the package is assembled as shown in FIG. 1.

The container 101 containing the ink jet cartridge is mounted on the supporting member 104 such that when the hook receiving portion 104*a* of the supporting member 104 is hooked, the head IJH of the ink jet cartridge takes a lower position in the direction of the gravity (arrow A).

If the head IJH is at an upper position, the ink moves downwardly with the result of introduction of the air through the ejection outlet to fill the ink passage and/or the ink chamber with bubbles.

Figure 23:
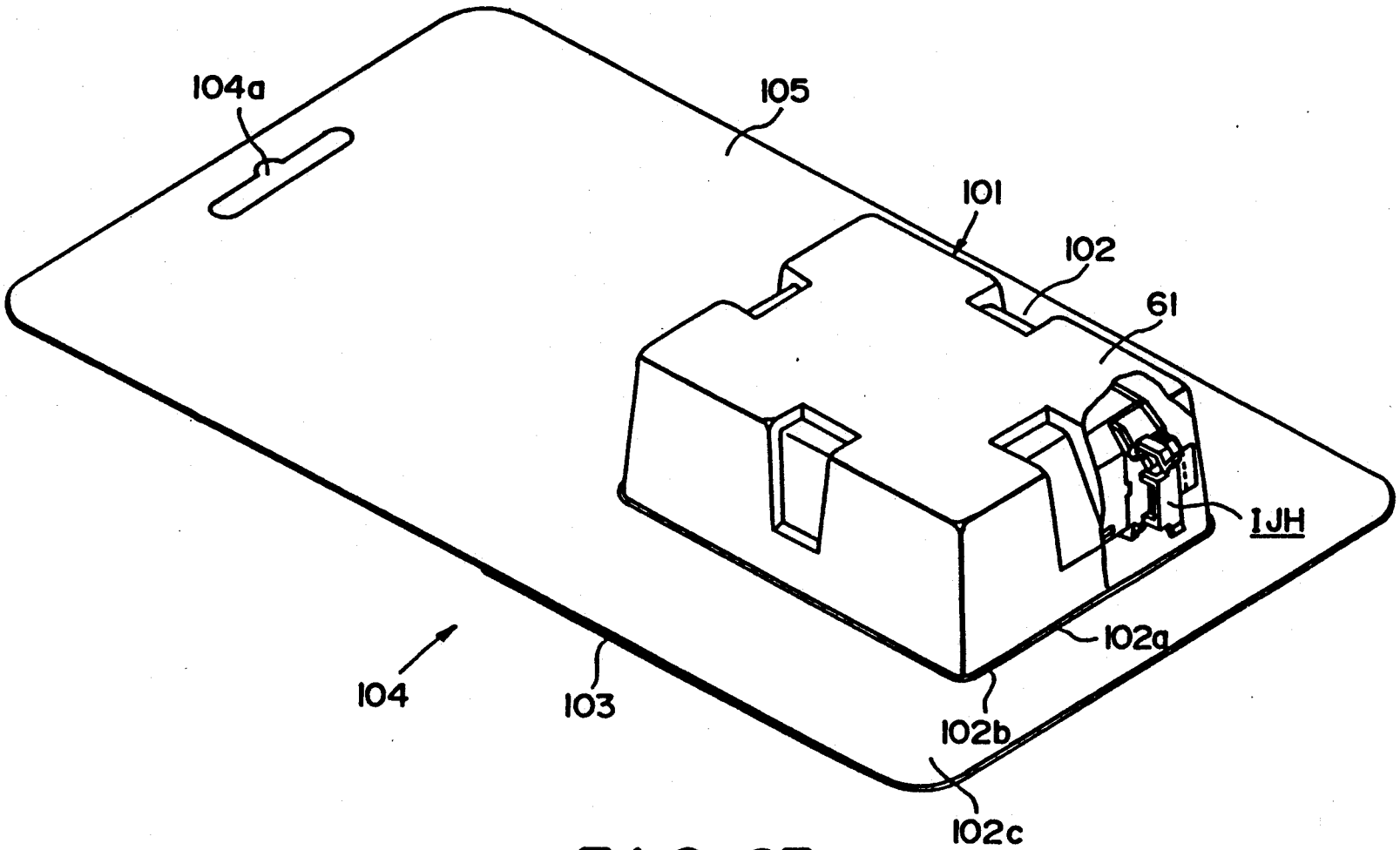
FIG. 23 is a perspective view of an embodiment wherein an accommodating container for the ink jet cartridge is mounted on a supporting member.

Therefore, when the ink jet cartridge is retained laterally, as shown in FIG. 1, or when the ink jet cartridge is vertically retained as shown in FIG. 23, it is preferable that the head IJH takes the lower position with respect to the direction of the gravity.

In this embodiment, the portion of the supporting member 104 corresponding to the container 101 has a dual structure, and therefore, even if an external shock is given by falling or the like, the shock can be sufficiently absorbed by the supporting member 104. Therefore, the container 101 is not deformed, and therefore, the ink jet cartridge can be properly accommodated without adverse influence thereto.

The supporting member 104, as shown in FIGS. 1 and 20A, is provided with a continuing flat surface adjacent the opening formed region 102, and therefore, the information area 105 is provided to have a label and information on how to take the ink jet cartridge out and how to manipulate it. The flat member 103 is such that it covers only the region where the opening 102*a* is formed, and therefore, the side thereof not having the opening cut 103*a*, that is, the opposite side from the container 101 side can be used as information region 105.

Figure 24:
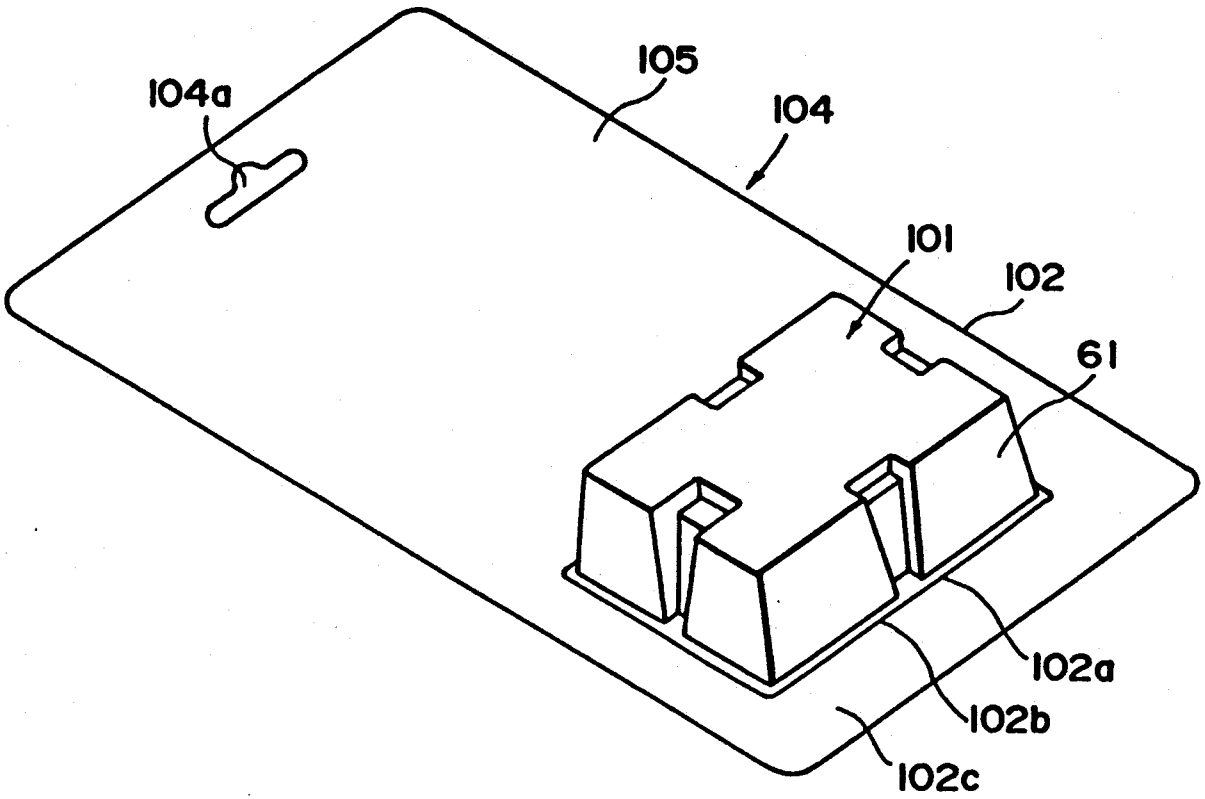
FIG. 24 is a perspective view of a package according to a further embodiment of the present invention.

Referring to FIGS. 24 and, 25A to 25C, a further embodiment will be described.

Figures 25A, 25B, 25C:
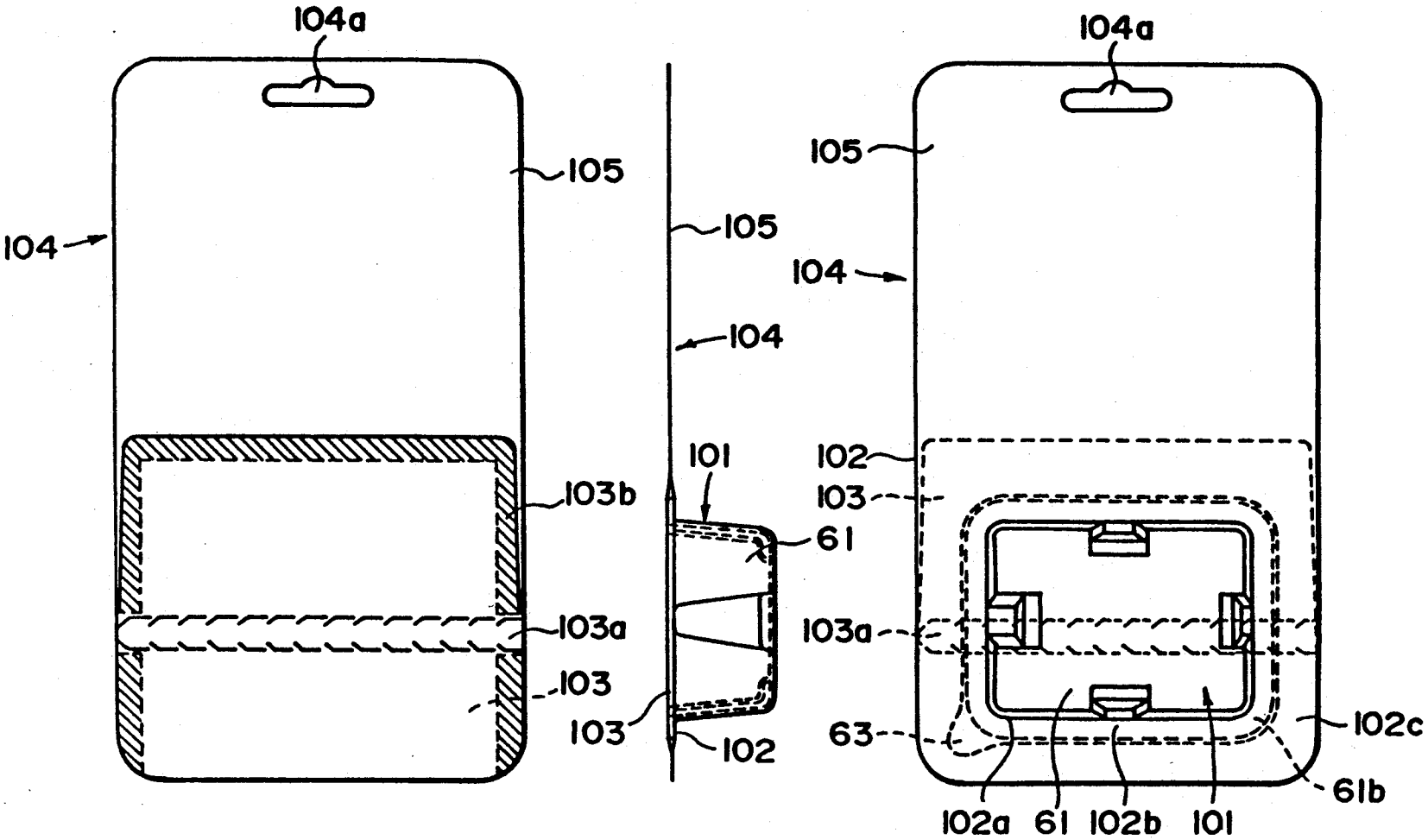
FIGS. 25A, 25B and 25C are a bottom plan view, a side view and a top plan view of the package shown in FIG. 24.

FIG. 24 is a perspective view of the passage according to this embodiment. FIGS. 25A, 25B and 25C are a side view, a top plan view and a bottom view, respectively of the package of this embodiment.

As shown in these Figures, the ink jet cartridge package has a base in the form of the container shown in FIG. 14, and it is supported. More particularly, it comprises an accommodating container 101 having a main body 61 capable of accommodating the ink jet cartridge and a flange 61*b* for bonding the main body 61 to the covering member 63 to seal the main body 61, an opening defining member 102 having an opening 102*a* having a size larger than the outer periphery of the main body 61 to permit insertion of the main body 61 therethrough, an edge contactable to the outer periphery of the flange 61*b* and a peripheral portion 102*c* of the edge 102*b* and a supporting member 104 disposed opposed to the opening defining member 102 and cooperable with the opening defining member 102 to sandwich the flange 61*b* therebetween. The opening defining member and the flat member 103 constitutes a supporting member 104.

This embodiment is similar to the ink jet cartridge package described in conjunction with FIGS. 1, 20A, 20B, 20C, 20D, 21, 22 and 23, except for the external structure of the main body 61 for accommodating the ink jet cartridge IJC. The structure of the container in this embodiment is shown in FIGS. 14, 15 and 19.

In the foregoing embodiments, the accommodating container contains the ink jet cartridge IJC. However it may contain toner, an ink ribbon, a floppy disk, a magnetic tape or another office material or various recording medium.

Figure 26A:
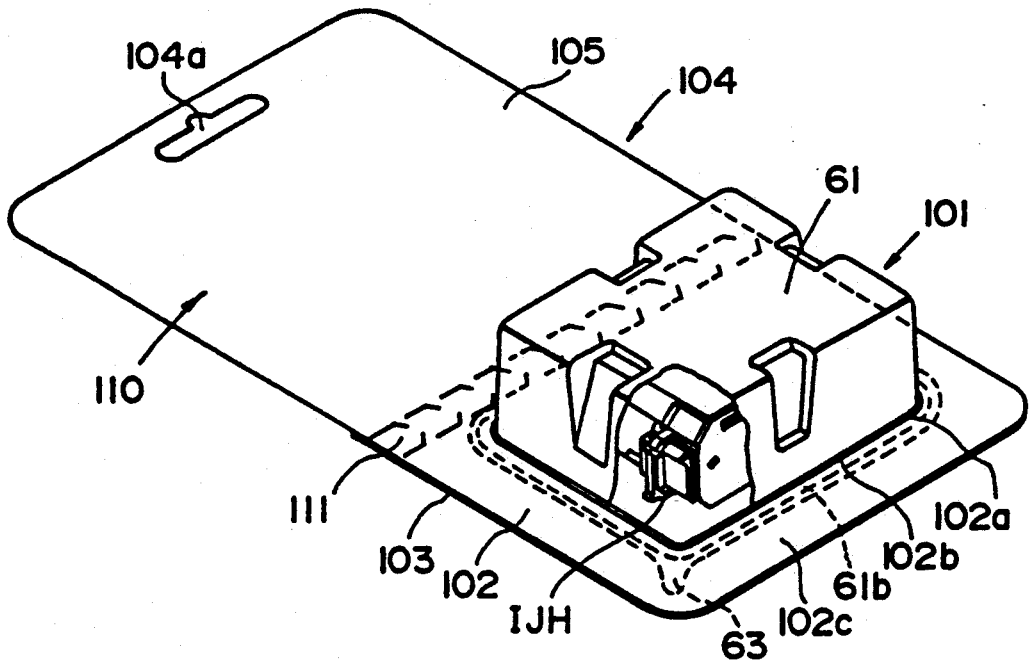
FIGS. 26A, 26B, 27A, 27B, 28A, 28B, 29A and 29B are perspective views of the packages according to further embodiments of the present invention.

FIGS. 26A and 26C show another embodiment. As shown in these Figures, in the region of the opening defining member for the bonding between a first member 110 and the flat member 103, an opening cut 111 is formed. The cut 111 is disposed adjacent the center of the first member 110 in FIG. 26A, and is disposed sandwiching the opening 102*a* of the opening defining member 102 in FIG. 26B. The cut 111 is peeled from one end toward the other in the form of a strip, by which it is opened like a zipper. When the opening cut 111 is in such a form as to provide a zipper, the bonding region 103*b* excludes the zipper.

The position of the zipper is not limited to this. For example, it is disposed at an end of the bonding region between the first member 110 and the flat member 103, or it may provide a vertical opening.

If the opening cut 111 is formed at a side wherein the opening 102*a* is formed, that is, it is formed in the front side, the cut 111 is not influenced even if the container 101 receives a shock to receive the pressing force at the backside (the flat member 103 side).

Figure 27A:
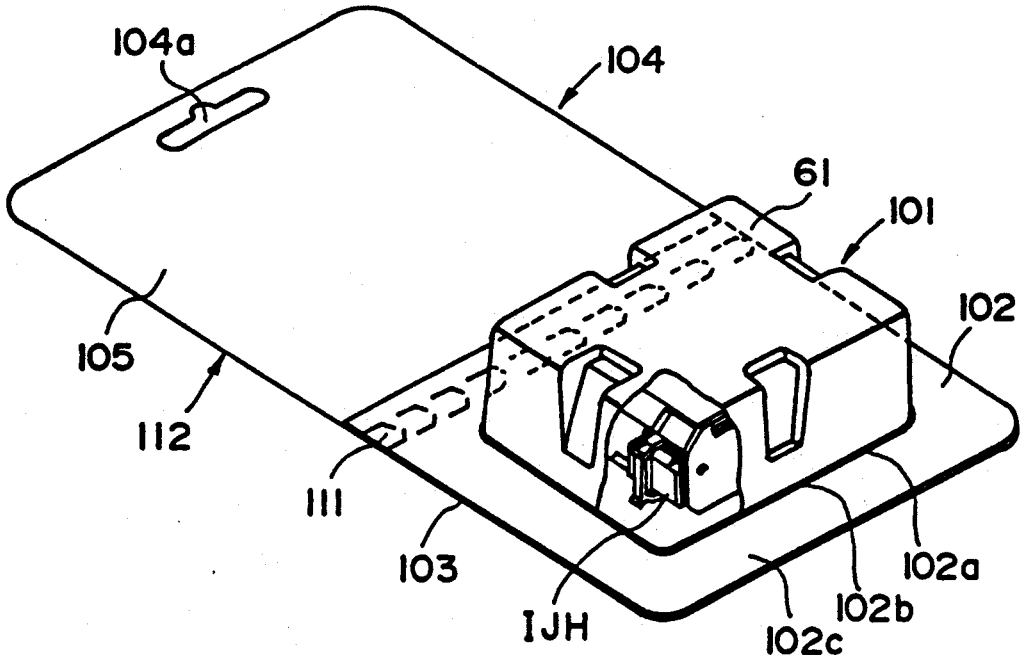
Figure 27B:
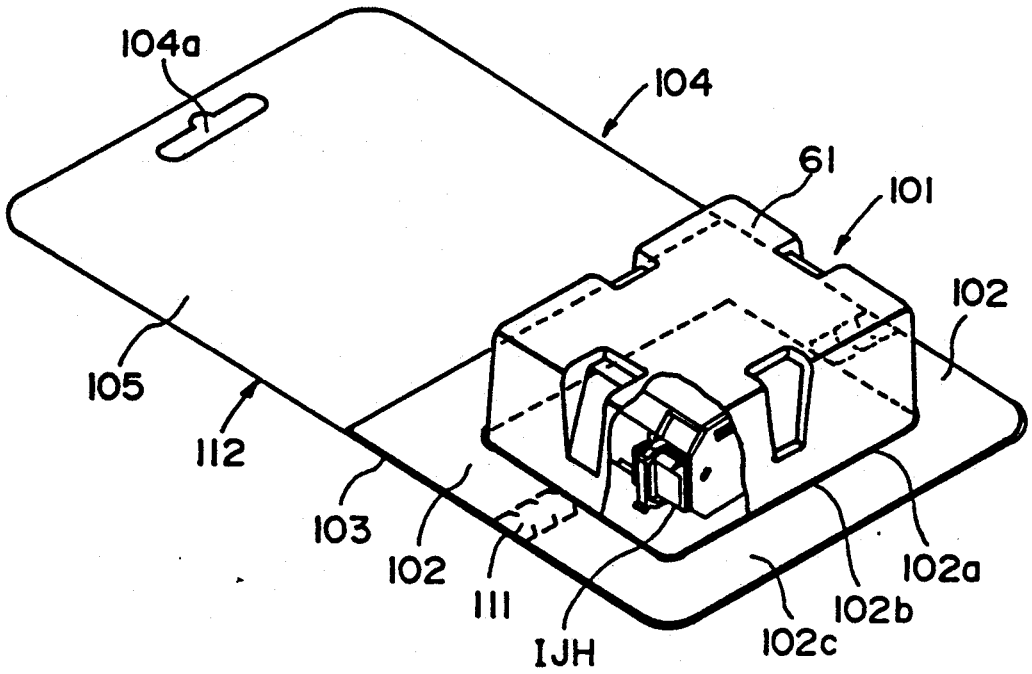
Figure 28A:
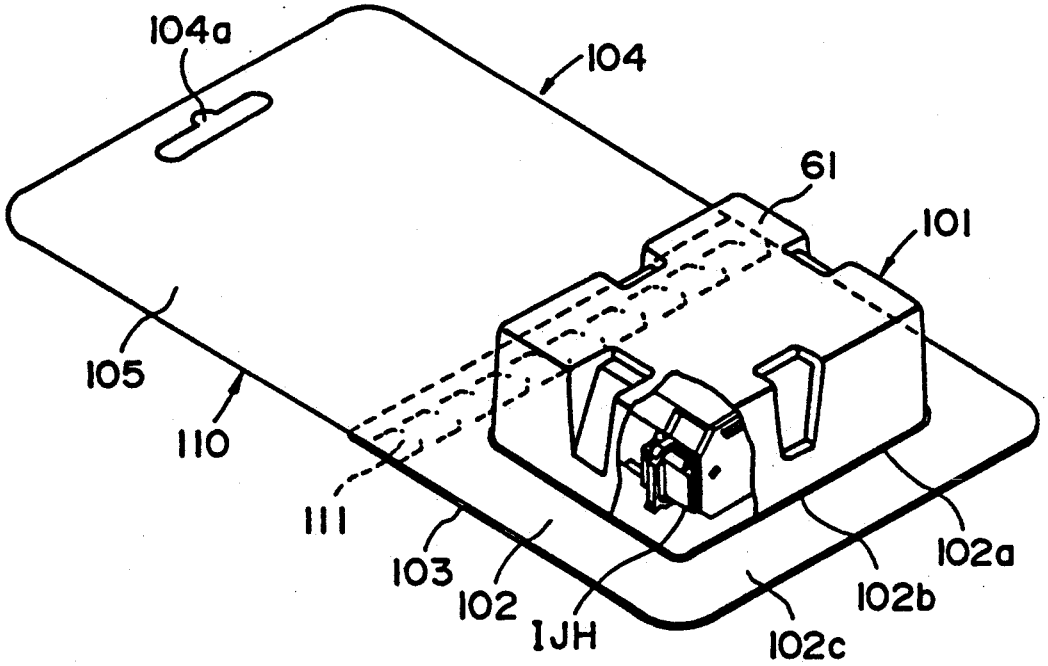
Figure 28B:
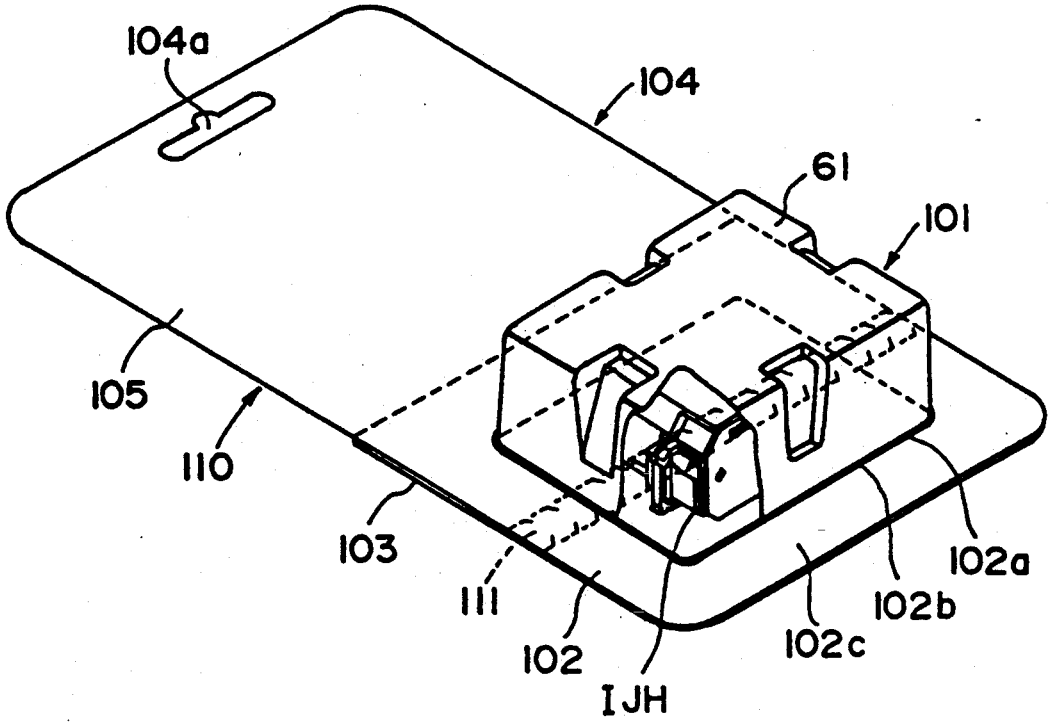
Figure 29A:
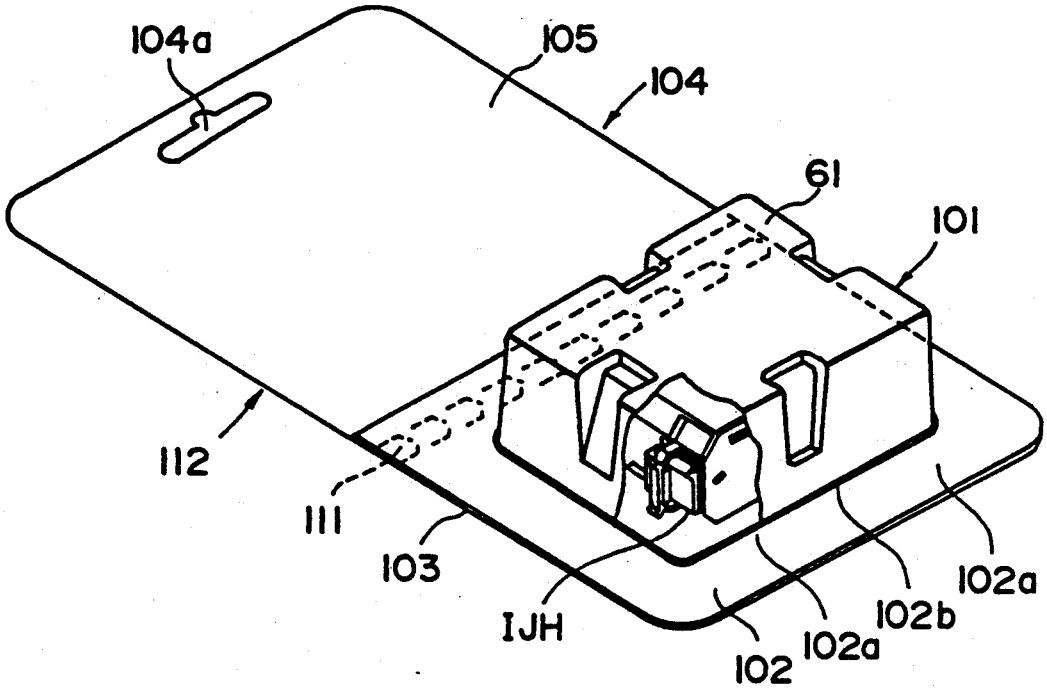
Figure 29B:
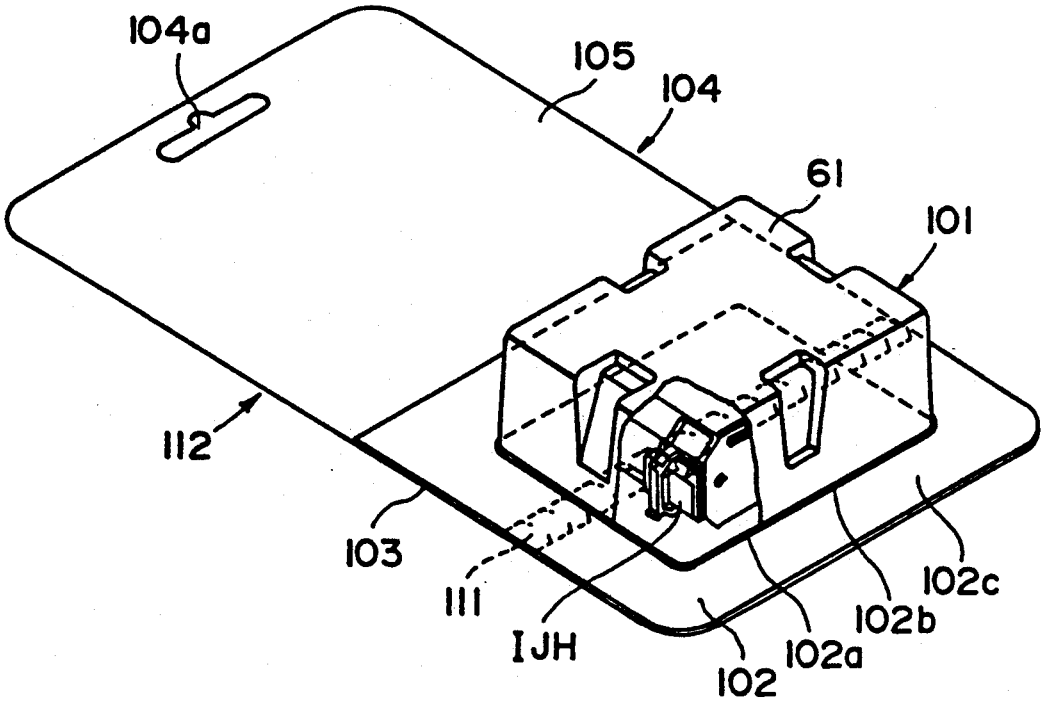

FIGS. 27A and 27B show a further embodiment, wherein the flat member 103 and the information area 105 constitute a continuous flat surface as a second member 112.

Figure 26B:
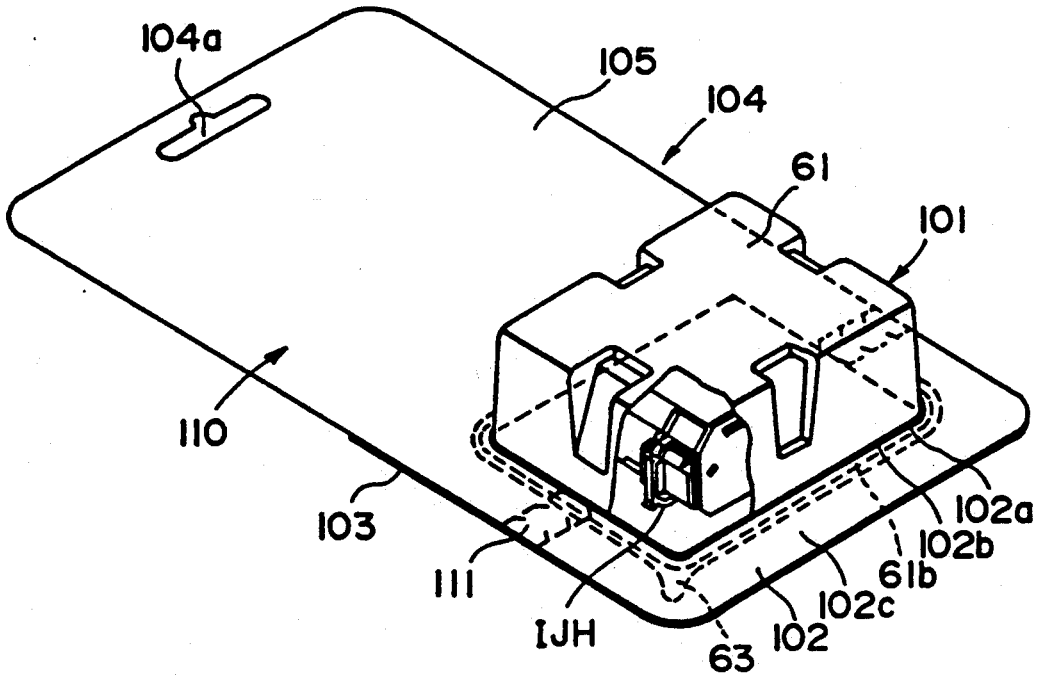

The opening cut 111 in FIGS. 27A and 27B is formed, similarly to FIGS. 26A and 26B, in the opening defining member 102 which is a front side member.

By constituting the opening defining member 102 as a separate member, the package can be simply constituted by positioning the opening defining member 102 relative to the second member 112 having the container 101.

FIGS. 28A, 28B, 29A, 29B, 26A, 26B, 27A and 27B show examples wherein the opening cut 111 is disposed at the backside.

When the opening cut 111 is disposed substantially at the center of the bonding region between the opening defining member 102 and the flat member 103, the cut 111 is not influenced even if the container 101 receives a shock, because the force is divided to separate portions of the flat member 103.

In this embodiment, the supporting member 104, particularly, the part thereof accommodating the container 101 has a dual structure using thick paper of separate members, and therefore, even if an external shock is given thereto by falling, for example, the shock is sufficiently absorbed by the supporting member 104. Therefore, the accommodating container 101 is not deformed, and the ink jet cartridge (contents of the package) is properly accommodated without adverse affect.

FIGS. 27A and 27B show a further embodiment. In this embodiment, the side of the folded flat region 103 of the supporting member 104 in FIGS. 1A and 1b, is provided with the opening 102*a*, and it is folded back toward the front side to fix the container 101. In other words, in FIGS. 1A and 1B, the opening 102*a* is formed in the member which is substantially rectangular having a long side extending vertically, and is folded toward the backside in the form of a regular square to sandwich the container 101. In the embodiment of FIGS. 27A and 27B, substantially a regular square member has the opening 102*a*, it is folded to the front side, and the container 101 is sandwiched form the backside by the flat member having a rectangular shape with a long side extending vertically.

In FIGS. 27A and 27B, the opening cut 111 is formed in the opening region 102 provided by the folding and constituting a front side. By doing so, the opening cut 111 is not easily broken by an external shock.

The above-described ink jet recording system may have a thermal energy generating element such as an electrothermal transducer in the ink passage, or a laser producing thermal energy.

The present invention is particularly suitably usable with a bubble jet recording head and recording apparatus developed by Canon Kabushiki Kaisha, Japan. This is because, the high density of the picture element, and the high resolution of recording are possible.

The typical structure and the operational principles are preferably those disclosed in U.S. Pat. Nos.

4,723,129 and 4,740,796. The principles are applicable to a so-called on-demand type recording system and a continuous type recording system. Particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can e formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single head corresponding to a single color ink, or may be plural heads corresponding tot he plurality of ink materials having different recording colors or densities. The present invention is effectively applicable to an apparatus having at least one of a monochromatic mode mainly with black and a multicolor with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left unused to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

According to an embodiment of the present invention, the flange of the container for accommodating the ink jet cartridge for maintaining the sealed state in the inside thereof is sandwiched by two facing surfaces, by which the function required as the container and the function for supporting the container and for buffering the external shock can be separated with a simple structure.

Therefore, the ink jet head cartridge which is fragile can be assuredly protected at low cost from the shock which may be given by the vibration or falling upon carrying it.

By the function separation effect, the container is assuredly supported by the facing surfaces. Therefore, under various conditions such as pressure-reduced condition, the sealing of the container is maintained. If the recording head is sealed under the normal ambient pressure condition, and if it is placed under a reduced pressure condition, the sealed portion may be peeled by the relative increase of the pressure.

According to an embodiment of the present invention, the opening cut is formed in one of the two surfaces sandwiching the accommodating container, and therefore, the opening is properly effected without damage to the container and the supporting member.

Therefore, the letter or characters on the surface of the supporting member are not damaged. Therefore, in the ink jet cartridge package, the description of the manipulation of the ink jet head cartridge or the like can be properly read.

According to an embodiment of the present invention, the head portion of the ink jet head cartridge in the container takes the lower position in the direction of the gravity, when it is exhibited. Therefore, the introduction of the air into the head is prevented.

Thus, even if the recording operation is started immediately after the recording head is taken out of the container, good printing is possible.

According to an embodiment of the present invention, the flange of the container for accommodating the ink jet cartridge in a sealed state to maintain the internal ambience is sandwiched by two facing surfaces, and therefore, the function as the accommodating container and the function of retaining it and buffering the external shock thereto can be separated with a simple structure.

While the invention has ben described with reference to the structures disclosed herein, it is not confined to the details set forth and this application and is intended to cover such modifications or changes as may come within the purpose of the improvements or the scope of the following claims.

What is claimed is:

1. In combination, an ink jet cartridge and a package for said ink jet cartridge, said combination comprising:

an ink jet cartridge, said ink jet cartridge including a recording head portion and an ink container portion containing ink to be supplied to said recording head portion;

a container including an accommodating portion for accommodating said ink jet cartridge, a flange internal with said accommodating portion and a cover for joining with said flange to seal said accommodating portion; and a holding member including an opening defining member for defining an opening through which an outer periphery of said accommodating portion can penetrate, a flat member disposed facing said opening defining member to sandwich said flange between said flat member and said opening defining member when the outer periphery of said accommodating portion is penetrated through said opening, and a hooking portion formed in at least one of said opening defining member and said flat member for permitting said package to be hung on a hook;

wherein said accommodating portion is so configured that the recording head portion takes a lower position than the ink container portion when said package is hung on a hook.

2. A combination according to claim 1, wherein said ink jet cartridge comprises electrothermal transducers for producing thermal energy contributable to ejection of ink through ejection outlets.

3. A combination according to claim 1, wherein said cover is provided with a tab adjacent a corner adjacent said recording head potion of said ink jet cartridge contained in said container.

4. A combination according to claim 1, wherein a surface of said i k jet cartridge including the ink ejection outlets is covered with a sheet material, which is urged by a capping member formed of an elastic material.

5. A combination according to claim 1, wherein said sheet material covers an air vent of said ink container portion.

* * * * *

UNITED STATES PATENT AND TRADEMARK OFFICE

CERTIFICATE OF CORRECTION

PATENT NO. : 5,244,092 Page 1 of 6

DATED : September 14, 1993

INVENTOR(S) : Seiichiro KARITA, et al.

It is certified that error appears in the above-indentified patent and that said Letters Patent is hereby corrected as shown below:

Title page,

AT [56] REFERENCES CITED - FOREIGN PATENT DOCUMENTS:

"6159557" should read --61-59557--.

COLUMN 1:

Line 39, "content." should read --contents.--;
Line 49, "example" should read --examples--;
Line 52, "content." should read --contents.--.

COLUMN 2:

Line 27, "shock absorbing" should read --shock-absorbing--.

COLUMN 4:

Line 14, "b" should read --by--.

COLUMN 5:

Line 24, "content" should read --contents--; and "content," should read --contents,--;
Line 41, "content" should read --contents--.

UNITED STATES PATENT AND TRADEMARK OFFICE

CERTIFICATE OF CORRECTION

PATENT NO. : 5,244,092 Page 2 of 6

DATED : September 14, 1993

INVENTOR(S) : Seiichiro KARITA, et al.

It is certified that error appears in the above-indentified patent and that said Letters Patent is hereby corrected as shown below:

COLUMN 6:

Line 15, "o" should read --of--;
Line 28, "container," should read --container),--.

COLUMN 7:

Line 27, "plate 400" should read --plate 400 are--;
Line 43, "surface" should read --surface 1--;
Line 48, "t" should read --to--;
Line 55, "enough" should read --large enough"--;
Line 57, "form" should read --from--;
Line 60, "form" should read --from--.

COLUMN 8:

Line 5, "deformation(reinforcing" should read --deformation (reinforcing--;
Line 21, late 10." should read --plate 10.--;
Line 41, "shows" should read --show--.

COLUMN 9:

Line 40, "extension" should read --the extension--.

UNITED STATES PATENT AND TRADEMARK OFFICE

CERTIFICATE OF CORRECTION

PATENT NO. : 5,244,092 Page 3 of 6

DATED : September 14, 1993

INVENTOR(S) : Seiichiro KARITA, et al.

It is certified that error appears in the above-indentified patent and that said Letters Patent is hereby corrected as shown below:

COLUMN 10:

Line 5, "enhanced Since" should read --enhanced. Since--;
Line 42, "god" should read --good--.

COLUMN 11:

Line 35, "carrier" should read --carriage,--;
Line 65, "extending" should read --extend--.

COLUMN 12:

Line 18, "pad 2001" should read --pad 2011--;
Line 29, "whole" should read --hole--;
Line 35, "ma" should read --may--; and "lever" should read --a lever--;
Line 56, "cartridge." should read --carriage.--.

COLUMN 13:

Line 11, "wall 61C" should read --wall 61c--;
Line 30, "ma" should read --may--.

COLUMN 14:

Line 56, "rom" should read --from--.

UNITED STATES PATENT AND TRADEMARK OFFICE

CERTIFICATE OF CORRECTION

PATENT NO. : 5,244,092 Page 4 of 6

DATED : September 14, 1993

INVENTOR(S) : Seiichiro KARITA, et al.

It is certified that error appears in the above-indentified patent and that said Letters Patent is hereby corrected as shown below:

COLUMN 15:

Line 8, "unpacked" should read --unpacked;--;
Line 26, "users" should read --user's--.

COLUMN 16:

Line 64, "form" should read --from--.

COLUMN 17:

Line 45, "sot hat" should read --so that--.
Line 46, "rom" should read -- from --.

COLUMN 18:

Line 29, "container 101," should read --container 101, and--.

COLUMN 19:

Line 10, "continuing" should read --continuous--;
Line 20, "and," should read --and--;
Line 25, "tively" should read --tively,--;
Line 42, "constitutes" should read --constitute--;
Line 51, "However" should read --However,--;

UNITED STATES PATENT AND TRADEMARK OFFICE

CERTIFICATE OF CORRECTION

PATENT NO. : 5,244,092 Page 5 of 6

DATED : September 14, 1993

INVENTOR(S) : Seiichiro KARITA, et al.

It is certified that error appears in the above-indentified patent and that said Letters Patent is hereby corrected as shown below:

Line 54, "medium." should read --mediums.--;
Line 55, "26C" should read --26B--.

COLUMN 20:

Line 38, "affect." should read --effect.--;
Line 39, "FIGS. 27A and 27B," should read --FIGS. 28A and 28B,--;
Line 41, "FIGS. 1A and 1b," should read --FIGS. 27A and 27B,--;
Line 44, "FIGS. 1A and 1B," should read --FIGS. 29A and 29B,--;
Line 51, "form" should read --from--;
Line 65, "element," should read --elements,--.

COLUMN 21:

Line 9, "nucleation" should read --nucleate--;
Line 13, "e" should read --be--.

COLUMN 22:

Line 1, "tot he" should read --to the--.

COLUMN 23:

Line 22, "ben" should read --been--;
Line 24, "and this" should read --in this--.

UNITED STATES PATENT AND TRADEMARK OFFICE

CERTIFICATE OF CORRECTION

PATENT NO. : 5,244,092 Page 6 of 6

DATED : September 14, 1993

INVENTOR(S) : Seiichiro KARITA, et al.

It is certified that error appears in the above-indentified patent and that said Letters Patent is hereby corrected as shown below:

COLUMN 24:

Line 1, "internal" should read --integral--;
Line 30, "i k" should read --ink--; and "the" should be deleted;
Line 33, "claim 1," should read --claim 4,--.

Signed and Sealed this

Ninth Day of August, 1994

Bruce Lehman

*Attest:*

BRUCE LEHMAN

*Attesting Officer*

*Commissioner of Patents and Trademarks*